US005719544A

United States Patent [19]

Vinciarelli et al.

[11] Patent Number: 5,719,544

[45] Date of Patent: Feb. 17, 1998

[54] TRANSFORMER WITH CONTROLLED INTERWINDING COUPLING AND CONTROLLED LEAKAGE INDUCANCES AND CIRCUIT USING SUCH TRANSFORMER

[75] Inventors: Patrizio Vinciarelli, Boston; Jay M. Prager, Tyngsboro, both of Mass.

[73] Assignee: VLT Corporation, San Antonio, Tex.

[21] Appl. No.: 679,190

[22] Filed: Jul. 12, 1996

Related U.S. Application Data

[60] Continuation of Ser. No. 896,411, Jun. 10, 1992, abandoned, which is a division of Ser. No. 759,511, Sep. 13, 1991, abandoned.

[51] Int. Cl.[6] ..... H01F 27/36; H01F 27/28

[52] U.S. Cl. ..... 336/84 C; 336/84 M; 336/84 R; 336/184

[58] Field of Search ..... 336/84 R, 84 C, 336/84 M, 184

[56] References Cited

U.S. PATENT DOCUMENTS

| | | | |
|---|---|---|---|
| 2,911,604 | 11/1959 | Krause | 336/196 X |
| 2,939,096 | 11/1960 | Gordon | 336/84 |
| 3,010,185 | 11/1961 | Hume | 29/155.58 |
| 3,032,729 | 5/1962 | Fluegel | 336/84 |
| 3,063,135 | 11/1962 | Clark | 29/155.57 |
| 3,123,787 | 3/1964 | Shifrin | 336/229 |
| 3,149,296 | 9/1964 | Cox | 336/84 |
| 3,154,840 | 11/1964 | Shahbender | 29/155.5 |
| 3,522,509 | 8/1970 | Hasenbalg | 321/2 |
| 3,851,287 | 11/1974 | Miller et al. | 336/84 R |
| 4,460,884 | 7/1984 | Post et al. | 336/84 C X |
| 4,464,544 | 8/1984 | Klein | 179/113 |
| 4,484,171 | 11/1984 | McLaughlin | 336/84 C X |
| 4,550,364 | 10/1985 | Shaw | 363/24 |

FOREIGN PATENT DOCUMENTS

| | | | |
|---|---|---|---|
| 430802 | 6/1991 | European Pat. Off. | 336/84 C |
| 229109 | 11/1909 | Germany . | |
| V 349985 | 7/1937 | Italy | 336/84 C |
| 139013 | 6/1986 | Japan | 336/84 R |
| 296407 | 12/1987 | Japan | 336/84 R |
| 63-18964 | 1/1988 | Japan | H02M 3/28 |
| 125076 | 3/1928 | Switzerland | 336/84 C |
| 9199305 | 12/1991 | WIPO | 336/84 R |

OTHER PUBLICATIONS

Holtje and Hall, "A High-Precision Impedance Comparator", *General Radio Experimenter*, vol., 30, No. 11, Apr. 1956, pp. 1–12.

Maurice et al., "Very-Wide Band Radio-Frequency Transformers", *Wireless Engineer*, Jun. 1947, pp. 168–177.

*Primary Examiner*—Michael L. Gellner
*Assistant Examiner*—Anh Mai
*Attorney, Agent, or Firm*—Fish & Richardson P.C.

[57] ABSTRACT

A transformer in which a magnetic medium provides flux paths within the medium, two or more windings enclose the flux paths at separated locations along the paths, and an electrically conductive medium, arranged in the vicinity of the magnetic medium and the windings, defines a boundary within which flux emanation from the magnetic medium and the windings is confined and suppressed. In a transformer constructed in accordance with the present invention, both controlled values of leakage inductance and the benefits of separated windings can be achieved. The conductive medium can be configured to reduce the leakage inductance of a controlled-leakage inductance transformer (e.g. for use in a zero-current switching power converter), having separately located windings, by at least 25%, and can be configured to reduce the leakage inductance of a low-leakage inductance transformer (e.g. for use in a PWM power converter), having separately located windings, by at least 75%.

39 Claims, 16 Drawing Sheets

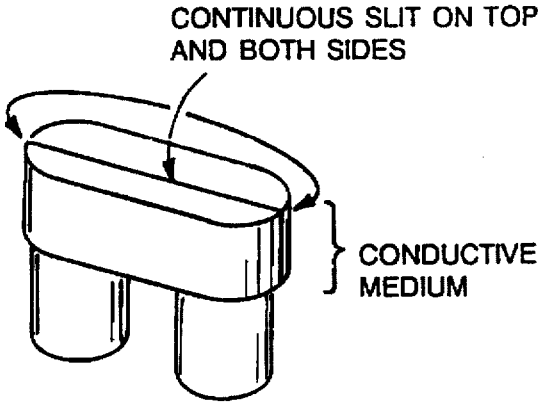
FIG.15a
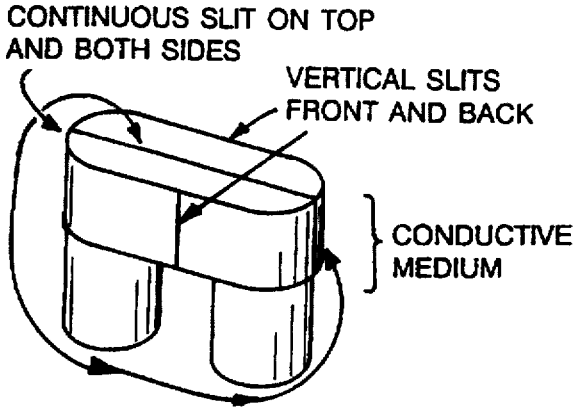
FIG. 15b
| Configuration of Conductive Medium | Inductance (μHenry) | Resistance (Ohms) |
|---|---|---|
| No Conductive Medium | 30.3 | 1.13 |
| Conductive Medium Without Slits | 15.3 | 2.98 |
| Slits on Top and Both Sides | 15.9 | 4.8 |
| Slits on Top and Both Sides and Vertical Slits on Front and Back | 16.7 | 6.4 |
FIG. 15c

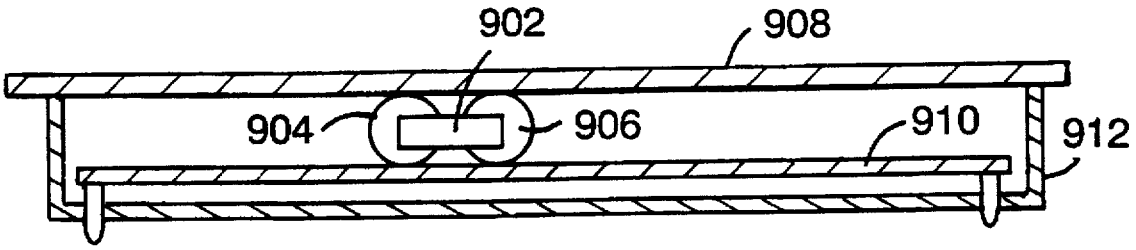

FIG. 19

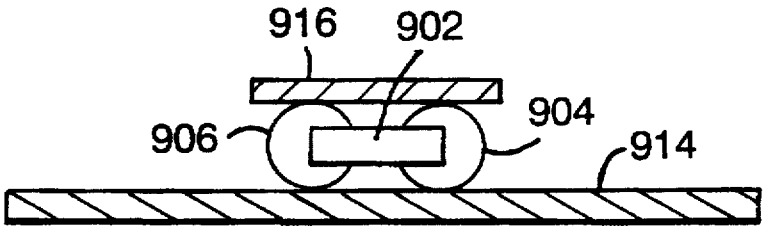

| Configuration of Conductive Medium | Inductance (μHenry) | Resistance (Ohms) |
|---|---|---|
| No Conductive Medium | 30.3 | 1.13 |
| Aluminum Plate 914 On One Side Only | 21.1 | 1.15 |
| Aluminum Plate 914 On One Side and Copper Plate 916 on Opposite Side | 14.5 | 1.44 |
| Aluminum Plate 914 On One Side, Copper Plate 916 on Opposite Side and Copper Cups over Both Ends of Magnetic Core | 8.35 | 1.68 |

FIG. 20

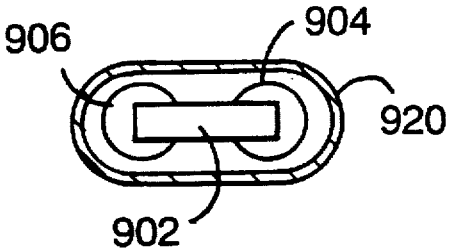

| Configuration of Conductive Medium | Inductance (μHenry) | Resistance (Ohms) |
|---|---|---|
| No Conductive Medium | 30.3 | 1.13 |
| Copper Tube 920 Surrounding Core and Windings | 7.16 | 1.21 |
| Copper Tube Surrounding Core and Windings and Copper Cups over Both Ends of Magnetic Core | 6.46 | 1.21 |

FIG. 21

TRANSFORMER WITH CONTROLLED INTERWINDING COUPLING AND CONTROLLED LEAKAGE INDUCANCES AND CIRCUIT USING SUCH TRANSFORMER

This application is a continuation of application Ser. No. 07/896,411, filed Jun. 10, 1992, which is a division of Ser. No. 07/759,511, filed Sep. 13, 1991, both now abandoned.

BACKGROUND OF THE INVENTION

This invention relates to controlling interwinding coupling coefficients and leakage inductances of a transformer, and use of such a transformer in a high-frequency switching circuit, such as, for example, a high frequency switching power converter.

With reference to FIG. 1, which shows a schematic representation of an electronic transformer having two windings 12, 14, the lines of flux associated with current flow in the windings will close upon themselves along a variety of paths. Some of the flux will link both windings (e.g. flux lines 16), and some will not (e.g. flux lines 20, 22, 23, 24, 26). Flux which links both windings is referred to as mutual flux; flux which links only one winding is referred to as leakage flux. The extent to which flux generated in one winding also links the other winding is expressed in terms of the winding's coupling coefficient: a coupling coefficient of unity implies perfect coupling (i.e. all of the flux which links that winding also links the other winding) and an absence of leakage flux (i.e. none of the flux which links that winding links that winding alone). From a circuit viewpoint, the effects of leakage flux are accounted for by associating an equivalent lumped value of leakage inductance with each winding. An increase in the coupling coefficient translates into a reduction in leakage inductance: as the coupling coefficient approaches unity, the leakage inductance of the winding approaches zero.

Control of leakage inductance is of importance in switching power converters, which effect transfer of power from a source to a load, via the medium of a transformer, by means of the opening and closing of one or more switching elements connected to the transformer's windings. Examples of switching power converters include DC-DC converters, switching amplifiers and cycloconverters. For example, in conventional pulse width modulated (PWM) converters, in which current in a transformer winding is interrupted by the opening and closing of one or more switching elements, and in which some or all of the energy stored in the leakage inductances is dissipated as switching losses in the switching elements, a low-leakage-inductance transformer (i.e. one in which efforts are made to reduce the leakage inductances to values which approach zero) is desired. For zero-current switching converters, in which a controlled amount of transformer leakage inductance forms part of the power train and governs various converter operating parameters (e.g. the value of characteristic time constant, the maximum output power rating of the converter; see, for example, Vinciarelli, U.S. Pat. No. 4,415,959, incorporated herein by reference), a controlled-leakage-inductance transformer (i.e. one which exhibits finite, controlled values of leakage inductance) is required. One trend in switching power conversion has been toward higher switching frequencies (i.e. the rate at which the switching elements included in a switching power converter are opened and closed). As switching frequency is increased (e.g. from 50 KHz to above 100 KHz) lower values of transformer leakage inductances are usually required to retain or improve converter performance. For example, if the transformer leakage inductances in a conventional PWM converter are fixed, then an increase in switching frequency will result in increased switching losses and an undesirable reduction in conversion efficiency (i.e. the fraction of the power drawn from the input source which is delivered to the load).

A transformer with widely separated windings has low interwinding (parasitic) capacitance, high static isolation, and is relatively simple to construct. In a conventional transformer, however, the coupling coefficients of the windings will decrease, and the leakage inductance will increase, as the windings are spaced farther apart. If, for example, a transformer is configured as shown in FIG. 1, then flux line 23, generated by winding #1, will not link winding #2 and will therefore form part of the leakage field of winding #1. If, however, winding #2 were brought closer to, or overlapped, winding #1, then flux line 23 would form part of the mutual flux linking winding #2 and this would result in an increase in the coupling coefficient and a decrease in leakage inductance. Thus, in a transformer of the kind shown in FIG. 1, the coupling coefficients and leakage inductances depend upon the spatial relationship between the windings.

Prior art techniques for controlling leakage inductance have focused on arranging the spatial relationship between windings. Maximizing coupling between windings has been achieved by physically overlapping the windings, and a variety of construction techniques (e.g. segmentation and interleaving of windings) have been described for optimizing coupling and reducing undesirable side effects (e.g. proximity effects) associated with proximate windings. In other prior art schemes, multifilar or coaxial windings have been utilized which encourage leakage flux cancellation as a consequence of the spatial relationships which exist between current carrying members which form the windings, or both the magnetic medium and the windings are formed out of a plurality of small interconnected assemblies, as in "matrix" transformers. Transformers utilizing multifilar or coaxial windings, or of matrix construction, exhibit essentially the same drawbacks as those using overlapping windings, but are even more difficult and complex to construct, especially where turns ratios other than unity are desired. Thus, prior art techniques for controlling coupling, which focus on proximity and construction of windings, sacrifice the benefits of winding separation.

It is well known that conductive shields can attenuate and alter the spatial distribution of a magnetic field. By appearing as a "shorted turn" to the component of time-varying magnetic flux which might otherwise impinge orthogonally to its surface, a conductive shield will support induced currents which will act to counteract the impinging field. Use of conductive shields around the outside of inductors and transformers is routinely used to minimize stray fields which might otherwise couple into nearby electrical assemblies. See, for example, Crepaz, Cerrino and Sommaruga, "The Reduction of the External Electromagnetic Field Produced by Reactors and Inductors for Power Electronics", ICEM, 1986. Use of an electric conductor and a cylindrical conducting ring as a means of reducing leakage fields in induction heaters are described, respectively, in Takeda, U.S. Pat. No. 4,145,591, and Miyoshi & Omori, "Reduction of Magnetic Flux Leakage From an Induction Heating Range", IEEE Transactions on Industry Applications, Vol 1A–19, No. 4, July/August 1983. British Patent Specification 990, 418, published Apr. 28, 1965, illustrates how conductive shields, which form a partial turn around both the core and the windings of a transformer having tapewound windings, can be used to modify the distribution of the leakage field near the edges of the tapewound windings, thereby reducing losses caused by interaction of the leakage field with the current in the windings. Persson, U.S. Pat. No. 4,259,654, achieves a similar result by extending the width of the turn of a tapewound winding which is closest to the magnetic core.

The effects of conductive shields on the distribution of electric fields is also well known. In transformers, conductive sheets have been used as "Faraday shields" to reduce electrostatic coupling (i.e. capacitive coupling) between primary and secondary windings.

SUMMARY OF THE INVENTION

In embodiments of the invention, enhanced coupling coefficients and reduced leakage inductances of the windings of a transformer can be achieved while at the same time spacing the windings apart along the core (e.g. along a magnetic medium that defines flux paths) to assure safe isolation of the windings and to reduce the cost and complexity of manufacturing. Such transformers are especially useful in high frequency switching power converters where cost of manufacture must be minimized and where leakage inductances must either be kept very low, or set at controlled low values, so as to maintain high levels of conversion efficiency or govern certain converter operating parameters. These advantages are achieved by providing an electrically conductive medium, in the vicinity of the magnetic medium and windings, which defines a boundary within which emanation of flux from the magnetic medium and windings is confined and suppressed. The electrically conductive medium confines and suppresses the leakage flux as a result of eddy currents induced in the electrically conductive medium by the leakage flux. By appropriately configuring the electrically conductive medium, the spatial distribution of the leakage flux can be controlled to achieve a variety of benefits.

Thus, in general, in one aspect, the invention features a high frequency circuit having a transformer. The transformer includes an electromagnetic coupler having a magnetic medium providing flux paths within the medium, two or more windings enclosing the flux paths at separated locations along the flux paths, and an electrically conductive medium arranged in the vicinity of the electromagnetic coupler. The electrically conductive medium defines a boundary within which flux emanating from the electromagnetic coupler is confined and suppressed. The conductive medium thereby reduces the leakage inductance of one or more of the windings by at least 25%. Circuitry is connected to one or more of the windings to cause current in one or more of the windings to vary at an operating frequency above 100 KHz.

Preferred embodiments of the invention include the following features. For use as a switching power converter, the circuitry includes one or more switching elements connected to the windings, and the operating frequency is the switching frequency of the switching power converter. The electrically conductive medium is configured to reduce the leakage inductances of one or more of the windings by at least 75% at the operating frequency. In some embodiments, the electrically conductive medium is configured to restrict the emanation of flux from selected locations along the flux paths other than the locations at which the windings are located. In other embodiments, the electrically conductive medium is configured also to restrict the emanation of flux from the magnetic medium at selected locations along the flux paths which are enclosed by the windings.

In some embodiments, some or all of the electrically conductive medium comprises electrically conductive material formed over the surface of the magnetic medium. In some embodiments, some or all of the electrically conductive medium comprises electrically conductive material arranged in the vicinity of the electromagnetic coupler in the environment outside of the magnetic medium and the windings.

The conductive medium is configured to define a preselected spatial distribution of flux outside of the magnetic medium, and is arranged to preclude forming a shorted turn with respect to flux which couples the windings. Some or all of the conductive medium may comprise sheet metal formed to lie on a surface of the magnetic medium, or may be plated on the surface of the magnetic medium, or may be metal foil wound over the surface of the magnetic medium. Some or all of the conductive medium may be comprised of two or more layers of conductive materials. Some or all of the conductive medium may comprise copper or silver, or a superconductor, or a layer of silver plated over a layer of copper.

The conductive medium may include apertures which control the spatial distribution of leakage flux which passes between the apertures. The reluctance of the path, or paths, between the apertures may be reduced by interposing a magnetic medium along a portion of the path, or paths, between the apertures. A second electrically conductive medium may enclose some or all of the region between the apertures, the second conductive medium acting to confine the flux to the region enclosed by the second conductive medium. The second conductive medium may form a hollow tube which connects a pair of the apertures, the hollow tube being arranged to preclude forming a shorted turn with respect to flux passing between the apertures.

The conductive medium may comprise one or more conductive metal patterns arranged over the surface of the magnetic medium at locations along the flux paths. The conductive medium may enshroud essentially all of the surface of the magnetic medium at each of several distinct locations along the flux paths, or may enshroud essentially the entire surface of the magnetic medium.

The conductive medium may comprise one or more electrically conductive sheets arranged in the vicinity of the electromagnetic coupler in the environment outside of the magnetic medium and the windings. The windings and the magnetic medium lie in a first plane and the metallic sheets lie in planes parallel to the first plane. The metallic sheets form one or more of the surfaces of a switching power converter which includes the high frequency circuit. In some embodiments, the conductive medium comprises a hollow open-ended metallic tube arranged outside of the electromagnetic coupler. The thickness of the conductive medium may be one or more skin depths (or three or more skin depths) at the operating frequency. The domain of the magnetic medium is either singly, doubly, or multiply connected. One or more of the flux paths includes one or more gaps. The magnetic medium is formed by combining two or more (e.g., U-shaped) magnetic core pieces. The core pieces may have different values of magnetic permeability. One or more of the windings comprise one or more wires (or conductive tape) wound around the flux paths (e.g., over the surface of a hollow bobbin, each bobbin enclosing a segment of the magnetic medium along the flux paths).

In some embodiments, at least one of the windings comprises conductive runs formed on a substrate to serve as one portion of the winding, and conductors connected to the conductive runs to serve as another portion of the winding, the conductors and the conductive runs being electrically connected to form the winding. At least one of the conductors is connected to at least two of the conductive runs. The substrate comprises a printed circuit board and the runs are formed on the surface of the board. The magnetic medium comprises a magnetic core structure which is enclosed by the windings. The magnetic core structure forms magnetic flux paths lying in a plane parallel to the surface of the substrate.

In some embodiments, the conductive medium comprises electrically conductive metallic cups, each of the cups fitting snugly over the closed ends of the core pieces. Electrically conductive bands may be configured to cover essentially all of the surface of the magnetic domain at locations which are not covered by the first conductive medium, the bands being configured to preclude forming a shorted turn with respect to flux which couples the windings, the bands also being configured to restrict the emanation of flux from the surfaces which are covered by the bands at the operating frequency.

In general, in other aspects, the invention features the transformer itself, a switching power converter, a switching power converter module, and methods of controlling or minimizing leakage inductance, minimizing switching losses in switching power converters, transforming power, and making lot-of-one transformers.

Other advantages and features will become apparent from the following description and from the claims.

DESCRIPTION

We first briefly describe the drawings.

FIGS. 15A through 15C illustrate the effects of slits in a conductive medium on the losses associated with the flow of induced currents in the conductive medium.

FIG. 19 is a sectional side view of a DC-DC converter module showing the spatial relationships between the core and windings of a transformer and a conductive metal cover.

FIG. 20 illustrates a transformer comprising a core and windings interposed between a conductive medium comprising parallel conductive plates and the effects of various arrangements of the conductive medium on the primary-referenced leakage impedance.

FIG. 21 illustrates a transformer comprising a core and windings enclosed within a conductive medium comprising a conductive metal tube and the effects of various arrangements of the conductive medium on the primary-referenced leakage impedance.

Figure 1:
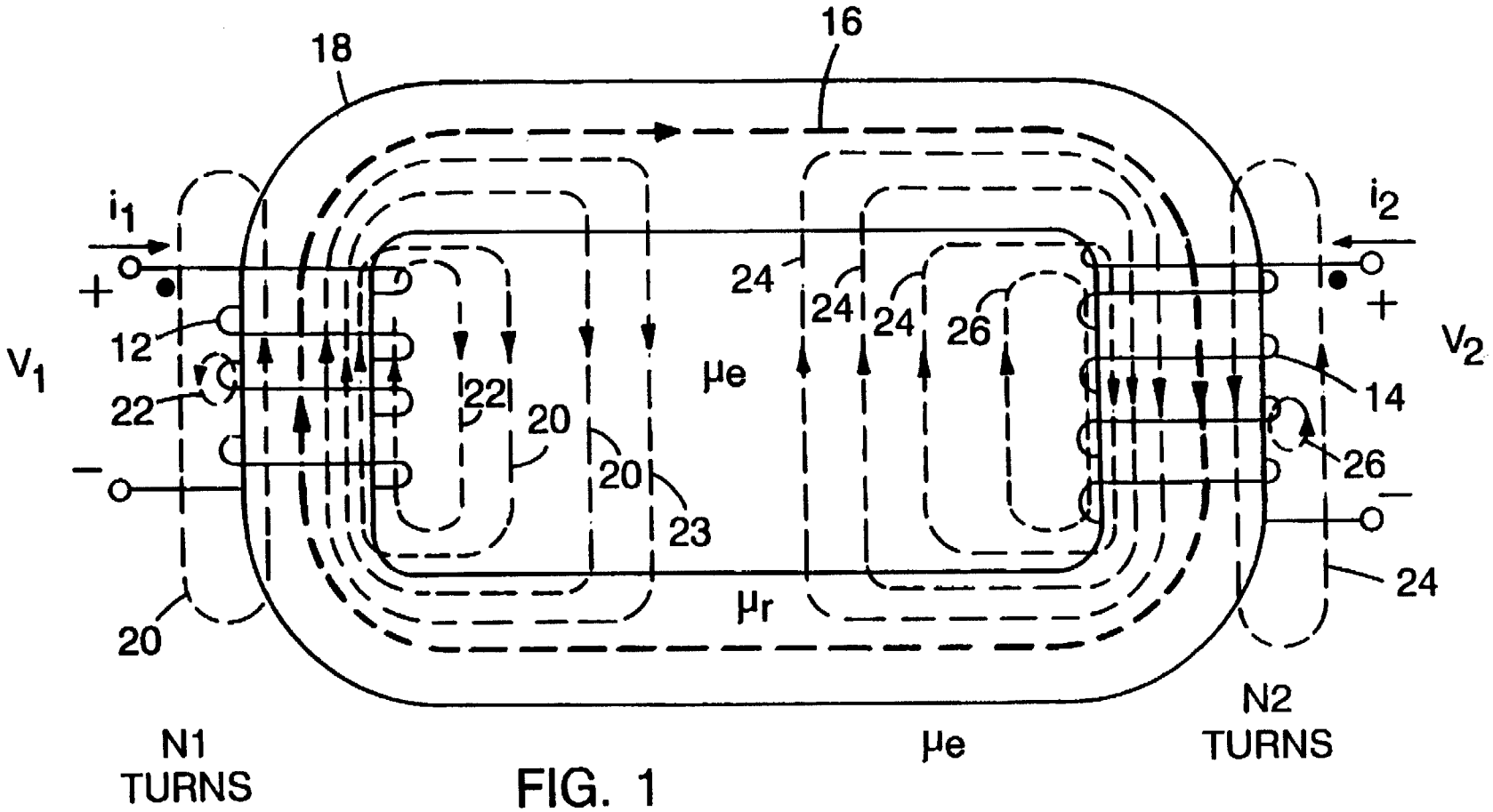
FIG. 1 PRIOR ART
FIG. 1 is a schematic view of a conventional two-winding transformer.

FIG. 1 is a schematic illustration of a two winding transformer. The transformer comprises a magnetic medium 18, having a permeability, $\mu r$ (which is greater than the permeability, $\mu e$, of the environment outside of the magnetic medium), and two windings: a primary winding 12 having N1 turns, and a secondary winding 14 having N2 turns. Both windings enclose the magnetic medium. Some of the lines of magnetic flux associated with current flow in the windings are shown as dashed lines in the Figure. Some of the flux links both windings (e.g. flux lines 16), and some does not (e.g. flux lines 20, 22, 23, 24 and 26). Flux which links both windings is referred to as mutual flux; flux which links one winding but which does not link the other is referred to as leakage flux. Thus, in FIG. 1, the flux lines can be segregated into three categories: lines of mutual flux, fm, which link both windings (e.g. lines 16); lines of leakage flux associated with the primary winding, fl1 (e.g. lines 20, 22, and 23); and lines of leakage flux associated with the secondary winding, fl2 (e.g. lines 24 and 26). The total flux linking the primary winding is therefore f1=fl1+fm, and the total flux linking the secondary winding is f2=fl2+fm. The degree to which flux generated in one winding links the other is usually characterized by defining a coupling coefficient for each winding:

$$k1 = \frac{df_{m1}}{df_1} = \frac{d(f_1 - f_{11})}{df_1} = 1 - \frac{df_{11}}{df_1} \quad (1)$$

where the changes in flux, df1 and dfm1, are due solely to changes in the current, i1, flowing in the primary winding, and $$k2 = \frac{df_{m2}}{df_2} = \frac{d(f_2 - f_{12})}{df_2} = 1 - \frac{df_{12}}{df_2} \quad (2)$$

where the changes in flux, df2 and dfm2, are due solely to changes in the current, i2, flowing in the secondary winding.

Figure 2:
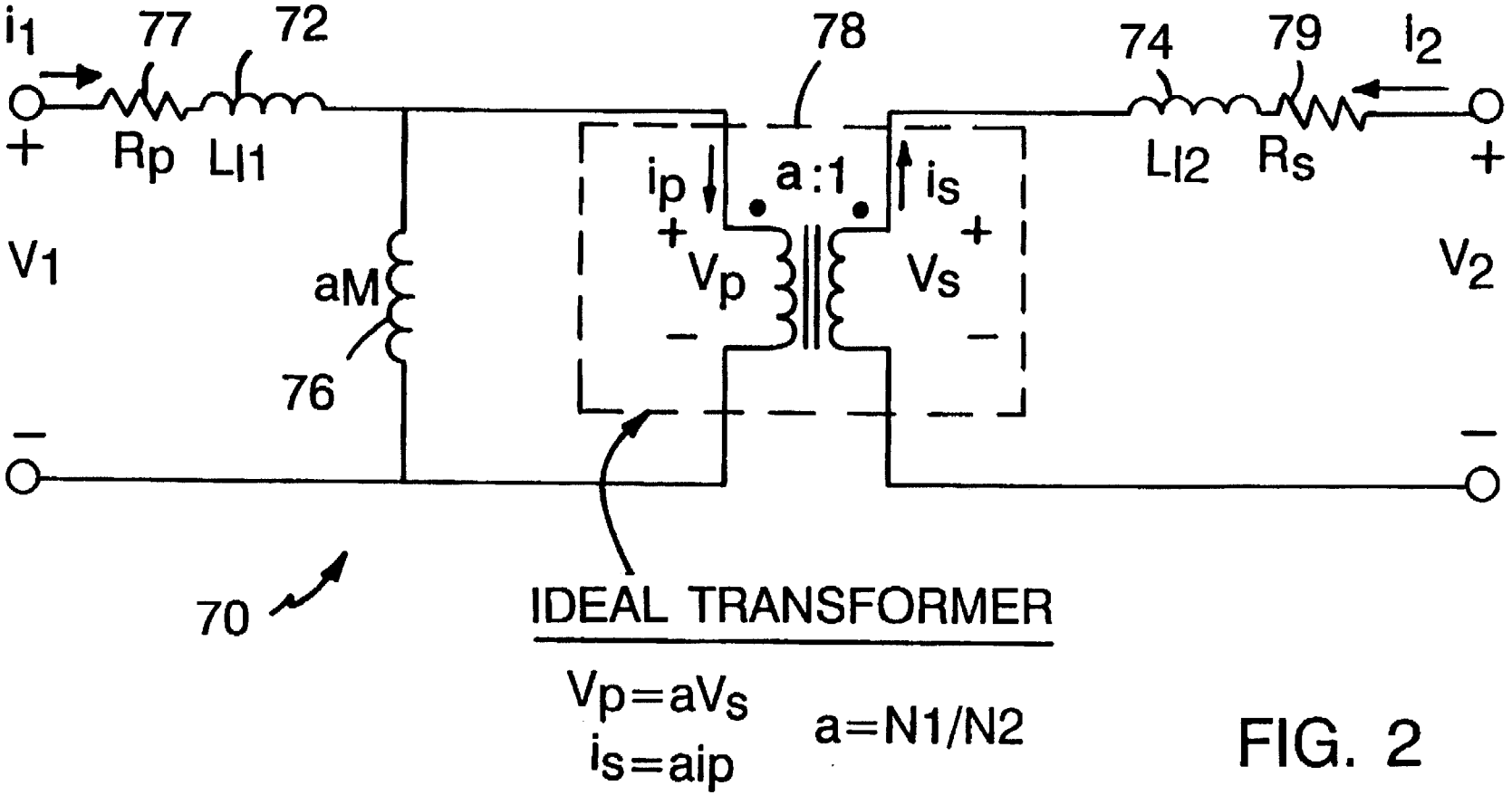
FIG. 2 is a linear circuit model of a two-winding transformer.

Leakage flux is solely a function of the current in one winding, whereas mutual flux is a function of the currents in both windings. Winding voltage, in accordance with Faraday's law, is proportional to the time rate-of-change of the total flux linking the winding. The voltage across either winding is therefore related to both the time rate-of-change of the current in the winding itself as well as the time rate of change of the current in the other winding. From a circuit viewpoint, the interdependencies between the winding voltages and currents are conventionally modeled by using lumped inductances, which, by relating gross changes in flux to changes in winding current, provide a means for directly associating winding voltages with the time rates-of-change of winding currents. FIG. 2 shows one such linear circuit model 70 for the two winding transformer of Figure 1 (see, for example, Hunt & Stein, "Static Electromagnetic Devices", Allyn & Bacon, Boston, 1963, pp. 114–137). The circuit model (which neglects interwinding and intrawinding capacitances) includes a primary leakage inductance 72, of value $$L11 = N1\frac{df_{11}}{di1}, \quad (3)$$

which accounts for the changes in total primary leakage flux in response to changes in primary winding current, i1; a secondary leakage inductance 74, of value $$L12 = N2\frac{df_{12}}{di2}, \quad (4)$$

which accounts for the changes in total secondary leakage flux in response to changes in secondary winding current, i2; an "ideal transformer" 78, having a turns ratio a=N1/N2, which accounts for the effects of turns ratio on the primary and secondary voltages and currents and for the electrical isolation between windings; a primary-referenced magnetizing inductance 76, of value aM, where M, the mutual inductance of the transformer, accounts for the total change in mutual flux linking one winding as a result of a change in current in the other; and resistances Rp 77 and Rs 79 which account for the ohmic resistance of the windings. Since, by definition, the mutual flux links both windings, an equal change in ampere-turns in either winding must produce an equal change in mutual flux. Thus, $$\frac{df_m}{d(N1i1)} = \frac{df_m}{d(N2i2)} \quad (5)$$

and $$M = N1\frac{df_m}{di2} = N2\frac{df_m}{di1}. \quad (6)$$

Thus, the relationships between the winding currents and voltages, as predicted by the circuit model of FIG. 2 are:

$$v1 - i1R1 = L1\frac{di1}{dt} + M\frac{di2}{dt}, \quad (7)$$

$$v2 - i2R2 = L2\frac{di2}{dt} + M\frac{di1}{dt}, \quad (8)$$

where L1 and L2 are, respectively, the total primary and secondary self-inductances:

$$L1 = L11 + a \cdot M \quad (9)$$

$$L2 = L12 + \frac{M}{a} \quad (10)$$

and these relationships can be shown to be consistent with behavior predicted by principles of electromagnetic induction. With reference to Equations 1 through 6, the coupling coefficients may be expressed in terms of the transformer inductances:

$$k1 = 1 - \frac{L11}{L1} \quad (11)$$

and $$k2 = 1 - \frac{L12}{L2}. \quad (12)$$

In most transformer applications, and particularly in the case of transformers which are used in switching power converters, both the relative and absolute values of the transformer inductances are of importance. In conventional PWM converters it is desirable to keep leakage inductances very low and magnetizing inductance high. In zero-current switching converters, high magnetizing inductance along with controlled and predictable values of leakage inductance are desired. For a conventional transformer of the kind shown in FIG. 1, mutual inductance (and, hence, magnetizing inductance), leakage inductances and coupling coefficients are dependent on both the physical arrangement and electromagnetic characteristics of the constituent parts. For example, increasing the permeability of the magnetic medium 18 will increase mutual and magnetizing inductance, but will have much less effect on leakage inductance (because some or all of the path lengths of all of the leakage flux lines lie in the lower permeability environment outside of the magnetic media). Thus, increasing the permeability of the magnetic medium will improve coupling and increase magnetizing inductance, but will have a much smaller effect on the values of the leakage inductances. If, however, the windings 12, 14 are moved closer together, or are made to overlap, then lines of flux which would otherwise form part of the leakage field of each winding can be "converted" into mutual flux which couples both windings. In this way, the ratio of leakage flux to mutual flux is decreased, resulting in a reduction in the values of the leakage inductances and an improvement in coupling coefficients. Conversely, further separating the windings, by, for example, increasing the length of the magnetic media which couples the windings, will result in increased leakage flux, increased leakage inductance, poorer coupling and decreased magnetizing inductance (due to a longer mutual flux path length). In general, then, in conventional transformers, leakage inductance values are dependent upon proximity of windings, and increased winding separation is inconsistent with low values of leakage inductance and high values of coupling coefficient.

There are, however, drawbacks associated with closely spaced windings. In switching power converters, for example, closer spacings between windings translate into reduced interwinding breakdown voltage ratings and increased interwinding capacitances. These drawbacks become more problematical as switching frequency is increased, since, for a given level of performance (e.g. efficiency in PWM DC-DC converters or switching amplifiers; power throughput in zero-current switching converters), operation at higher frequencies usually demands even lower values of leakage inductances. Thus, at higher switching frequencies (e.g. above 100 KHz), it becomes more difficult, using prior art constructions, to provide low enough values of leakage inductance while maintaining appropriate levels of interwinding voltage isolation and low values of interwinding capacitance. It is one object of the present invention, then, to simultaneously provide for: (a) accommodating separated windings as a means of providing high interwinding breakdown voltage and low interwinding capacitance, (b) achieving very low, or controlled, values of leakage inductances, and (c) maintaining high values of coupling coefficients. These attributes are of particular value in switching power converters which operate at relatively high frequencies (e.g. above 100 KHz).

Figure 3:
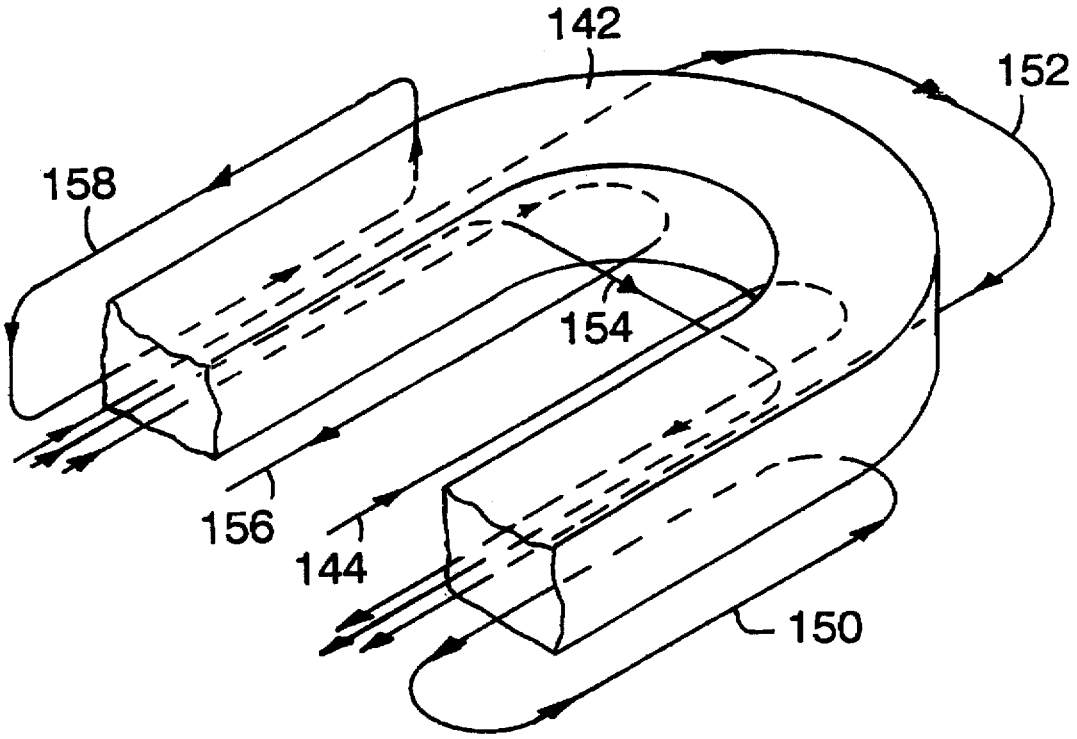
FIG. 3 is a perspective view of flux lines in the vicinity of a core piece.
Figure 4:
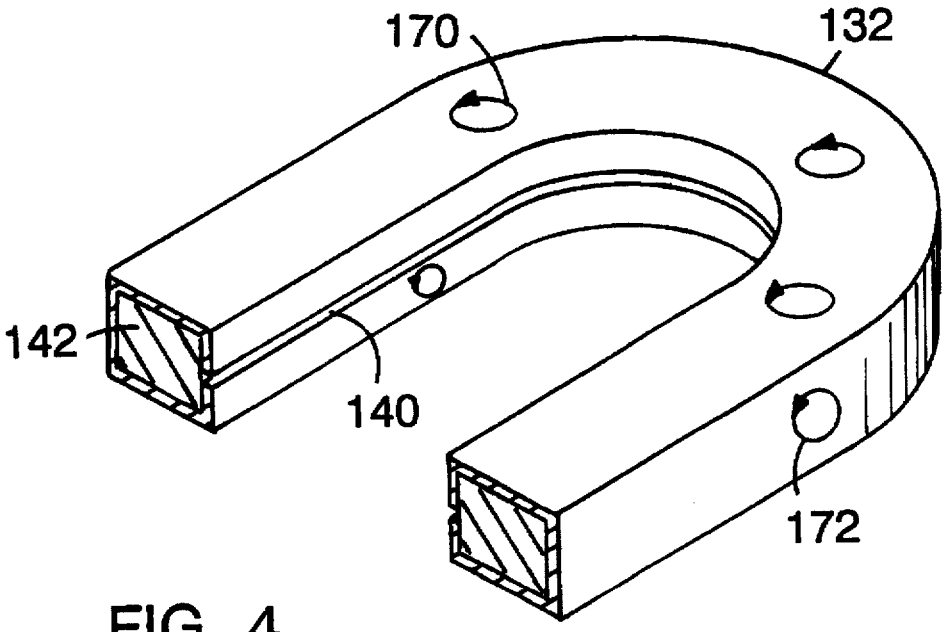
FIG. 4 is a perspective view of flux lines and induced current loops in the vicinity of a core piece covered with a conductive medium.

Instead of adjusting the spatial relationship between windings to achieve maximum flux linkage, a transformer according to the present invention uses a conductive medium to enhance flux linkage by selectively controlling the spatial distribution of flux in regions outside of the magnetic medium. If the conductive medium has an appropriate thickness (discussed below) then, at or above some desired transformer operating frequency, it will define a boundary which efficiently contains and suppresses leakage flux and increases the coupling coefficient of the transformer. For example, FIG. 3 illustrates a portion of closed magnetic core structure 142 which is not covered with a conductive medium. Lines of time-varying flux 144, 150, 152, 154, 156, 158 (produced, for example, by current flow in windings on the two legs of the core, which windings are, for clarity, not shown) are broadly distributed outside of the core. Flux lines 152 and 154 are lines of mutual flux (i.e. they would link both of the windings) which follow paths which are partially within the core and partially outside of the core. Flux lines 144, 150, 156 and 158 are lines of leakage flux (i.e. they would link only one of the windings) FIG. 4 shows the core 142 housed by a conductive medium comprising a conductive sheet 132 formed over the surface of the core. A slit 140 prevents the sheet from appearing as a "shorted turn" to the time-varying flux which is carried within the magnetic medium. In those areas of the core which are covered by the conductive sheet, emanation of flux from the core in a direction orthogonal to the surface of the conductive sheet will be counteracted by induced currents (e.g. 170, 172) which flow in the conductive medium.

Figure 5:
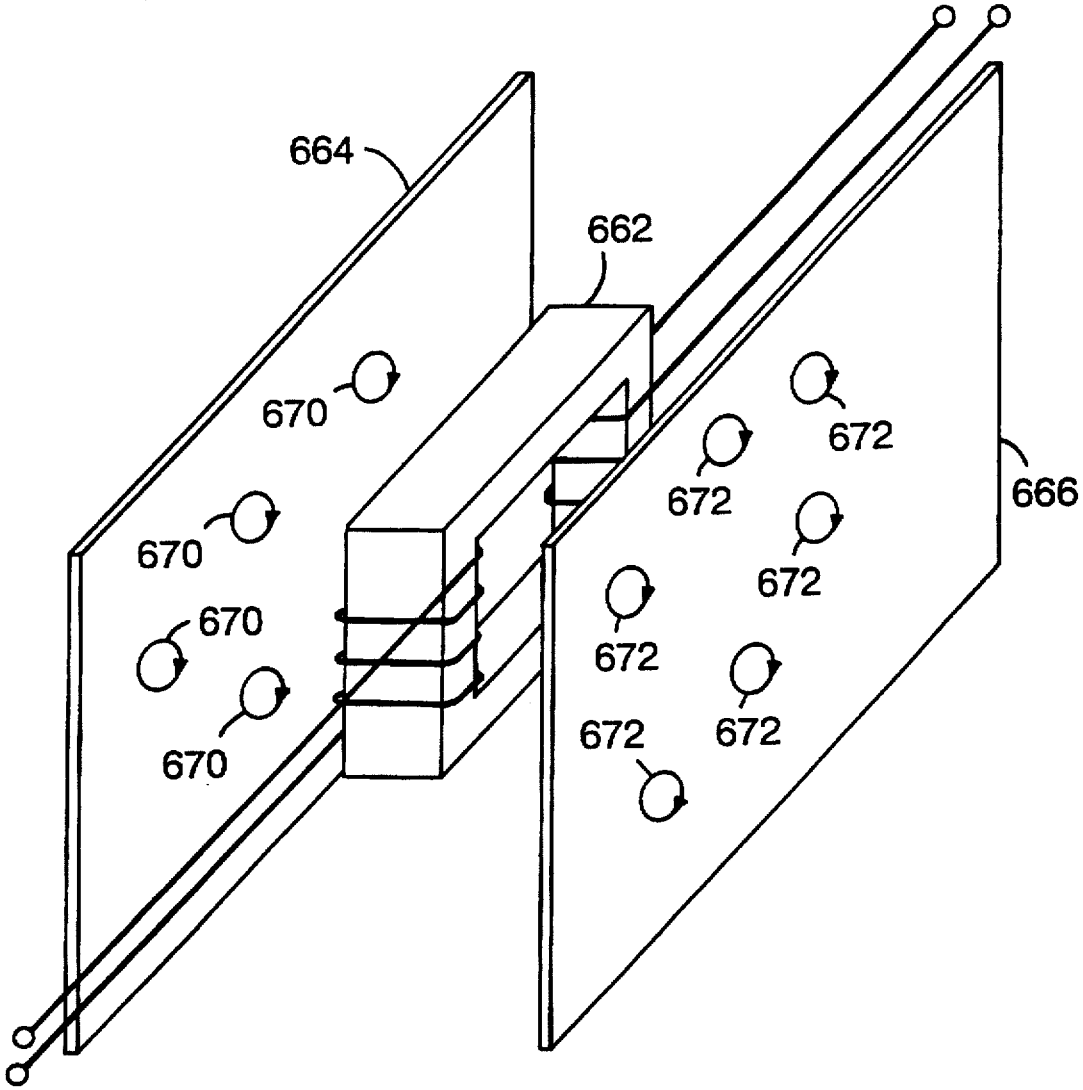
FIG. 5 is a perspective view of a conductive medium comprising conductive sheets arranged in the environment outside of the magnetic medium and windings.

In the embodiment of FIG. 4, where the conductive medium lies on the surface of the magnetic medium, the conductive medium can contain and suppress flux which would otherwise follow paths which lie partially within and partially outside of the magnetic medium. With reference to FIG. 1, however, certain leakage flux paths lie entirely outside of the magnetic medium (e.g. in FIG. 1, flux lines 22 and 26). In another embodiment, shown schematically in FIG. 5, the conductive medium is arranged so that it contains and suppresses flux which emanates from the surfaces of the magnetic medium, as well as flux which follows paths outside of the magnetic medium. In the Figure, a transformer 662 having separated windings is arranged between sheets 664, 666 of electrically conductive material. Emanation of flux from the core or windings in a direction orthogonal to the surface of the conductive sheets will be counteracted by induced currents (e.g. 670, 672) which flow in the conductive sheets. In general, the embodiments of FIGS. 4 and 5 can be combined: flux supression and confinement can be achieved by combining conductive media which lay on the surface of the magnetic medium, with conductive media which are in the vicinity of, but located in the environment outside of, the magnetic medium and windings. By acting to confine and suppress leakage flux within domains bounded by the conductive media, the effect of conductive media of appropriate conductivity and thickness is to decrease the leakage inductance and increase the coupling coefficients. Thus, rather than adjusting winding proximity as a means of linking flux which emanates from the magnetic media (and which would otherwise contribute to the leakage field), a transformer according to the present invention utilizes conductive media to define boundaries outside of the magnetic medium and windings within which leakage flux is confined and suppressed. The spatial distribution of leakage fields, in transformers with separated windings, may be engineered to allow leakage inductance to be controlled, or minimized, essentially independently of winding proximity.

Figure 6:
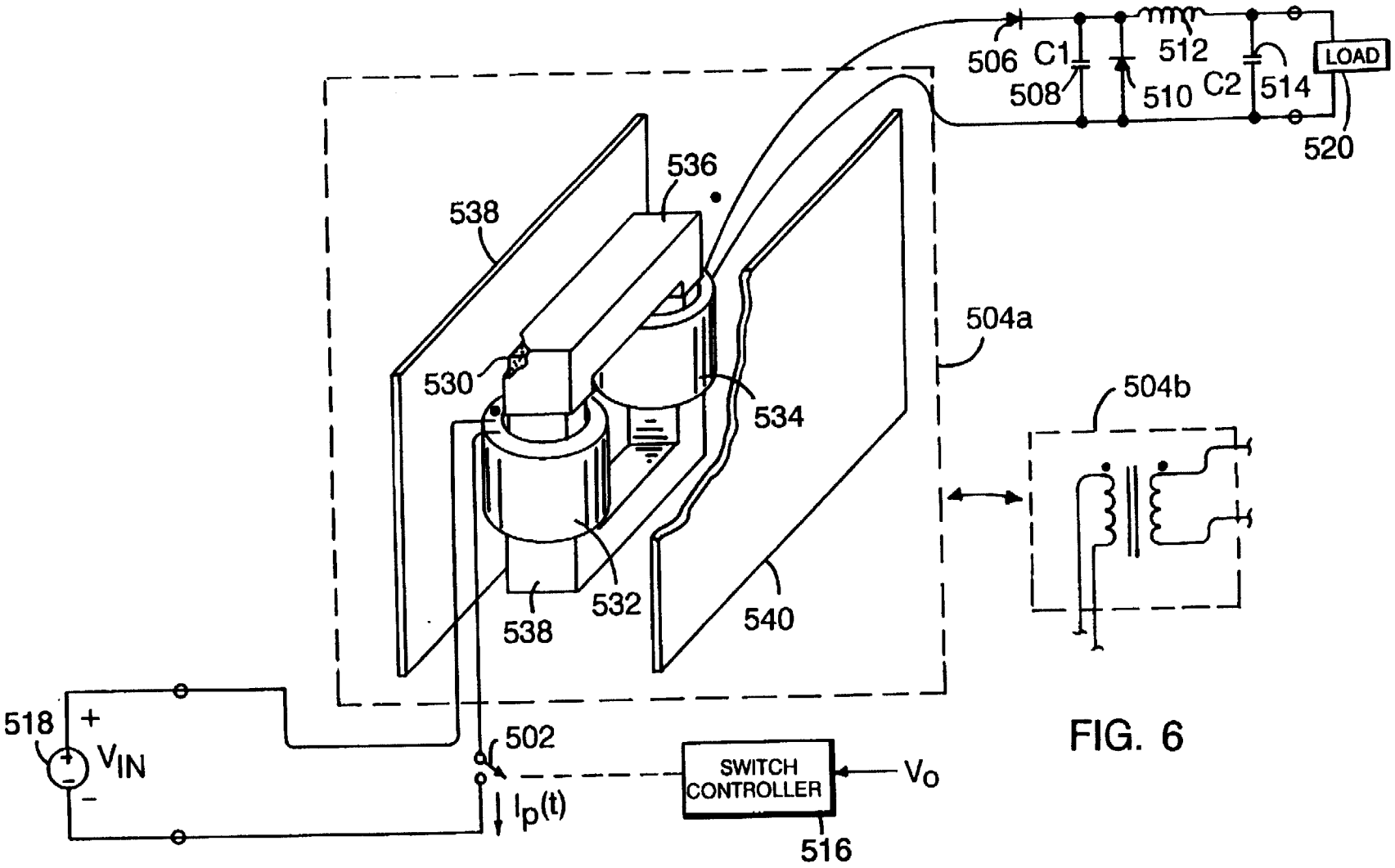
FIG. 6 is a schematic diagram of a switching power converter circuit which includes a transformer according to the present invention.

FIG. 6 shows, schematically, one example of a switching power converter circuit which includes a transformer according to the present invention. The switching power converter circuit shown in the Figure is a forward converter switching at zero-current, which operates as described in Vinciarelli, U.S. Pat. No. 4,415,959. In the Figure, the converter comprises a switch 502, a transformer 504 (for clarity both a schematic construction view 504A, partially cut away, of the transformer is shown, as is a schematic circuit diagram 504B which better indicates the polarity of the windings), a first unidirectional conducting device 506, a first capacitor 508 of value C1, a second unidirectional conducting device 510, an output inductor 512, a second capacitor 514, and a switch controller 516. The converter input is connected to an input voltage source 518, of value Vin; and the voltage output, Vo, of the converter is delivered to a load 520. The transformer 504A comprises a magnetic medium 530, separated primary 532 and secondary 534 windings, and a conductive medium. Portions of the conductive medium 536, 538 lie on the surface of the magnetic medium (one 536 being partially cut away to show the underlying magnetic medium); other portions of the conductive medium 538, 540 are in the vicinity of, but located in the environment outside of, the magnetic medium and the windings (one 540 being cut away for clarity). The transformer is characterized by a ratio of primary to secondary turns, N1/N2=a, primary and secondary coupling coefficients k1 and k2, respectively, both of which are close to unity in value, a primary leakage inductance of value Ll1, and a secondary leakage inductance of value Ll2. The secondary-referenced equivalent leakage inductance of the transformer is approximately equal to $Le=Ll2+(Ll1/a^2)$. In operation, closure of the switch by the switch controller 516 (at times of zero current flow in the switch 502) causes the switch current, Ip(t) (and, as a result, the current, Is(t), flowing in the secondary winding and the first diode), to rise and fall during an energy transfer phase having a a characteristic time scale pi·sqrt(Le·C1). When the switch current returns to zero the switch controller opens the switch. The pulsating voltage across the first capacitor is filtered by the output inductor and the second capacitor, producing an essentially DC voltage, Vo, across the load. The switch controller compares the load voltage, Vo, to a reference voltage, which is indicative of some desired value of converter output voltage and which is included in the switch controller but not shown in the Figure, and adjusts the switching frequency (i.e. the rate at which the switch is closed and opened) as a means of maintaining the load voltage at the desired value. As indicated in Vinciarelli, U.S. Pat. No. 4,415,959, (a) converter efficiency is improved as the coupling coefficients of the transformer approach unity; (b) a controlled value of Le is a determinant in setting both the maximum converter output power rating and the converter output frequency, and (c) decreasing the value of Le corresponds to increased values of both maximum allowable converter output power and converter operating frequency. Both high coupling coefficients (i.e. approaching unity) and controlled low values of leakage inductances are therefore desirable in such a converter. Traditionally, prior art transformer constructions (e.g. overlaid windings) have been used to achieve this combination of transformer parameters. However, compared to transformer constructions using separated windings, prior art constructions are more complex, have higher interwinding capacitances, and require much more complex interwinding insulation systems to ensure appropriate, and safe, values of primary to secondary breakdown voltage ratings.

The effectiveness of the conductive medium in any given application will depend upon its conductivity and thickness. The thickness of the conductive medium is selected to ensure that the conductive medium can act as an effective barrier to flux at or above the operating frequency of the transformer, and, in this regard, the figure of merit is the skin depth of the conductive material at frequencies of interest:

$$\delta = \frac{1}{2\pi}\sqrt{\frac{10^7 \cdot \rho}{f \cdot \mu_r}} \tag{13}$$

where d is the skin depth in meters, μ is the resistivity of the material in ohm-meters, $\mu_r$ is the relative permeability of the material, and f is the frequency in Hertz. Skin depth is indicative of the depth of the induced current distribution (and the penetration depth of the flux field) near the surface of the material (see, for example, Jackson, "Classical Electrodynamics", 2nd Edition, John Wiley and Sons, copyright 1975, pp. 298, 335–339). For a perfectly conducting medium (i.e. a material for which pρ=0, for example, a "superconductor"), skin depth is zero and induced currents may flow in the conductive medium in a region of zero depth without loss. Under these circumstances, there can be no flux either inside or outside of the conductive medium which is orthogonal to the surface. For finite resistivity, the depth of the induced current distribution near the surface of the material will increase with resistivity and decrease with frequency. In general, use of high conductivity material (e.g. silver, copper) is preferred both to minimize skin depth and to minimize losses associated with induced current flow. The thickness of the conductive medium, and the degree to which it enshrouds the magnetic medium, will, however, be application dependent. A conductive medium with a thickness greater than or equal to three skin depths at the operating frequency of the transformer (i.e. at the lowest frequency associated with the frequency spectrum of the current waveforms in the windings) will be essentially impregnable to flux, and such a conductive medium, enshrouding essentially the entire surface of the magnetic medium, would be appropriate where minimum leakage inductance is desired (e.g. in a low-leakage inductance transformer for use in a PWM power converter). For copper having a resisitivity of $3\cdot10^{-8}$ ohm-meter, three skin depths corresponds to 0.26 mm ($10\cdot3\cdot10^{-3}$ inches) at 1 MHz; 0.52 mm (0.021 inches) at 250 KHz; 0.83 mm (0.033 inches) at 100 KHz; 1.9 mm (0.073 inches) at 20 KHz; and 33.8 mm (1.33 inches) at 60 Hz. Conductive media which are thinner than three skin depths at the transformer operating frequency, and which cover only a portion of the surface of the magnetic medium, can also provide significant flux confinement and reduction of leakage inductance, and, in general, a controlled amount of leakage inductance can often be achieved by use of either a relatively thin conductive medium (e.g. one skin depth at the transformer operating frequency) covering an appropriate percentage of the surface of the magnetic medium, or by use of a thicker conductive medium (e.g. three or more skin depths) covering a smaller percentage. In general, thicker coatings covering smaller areas are preferred because losses associated with flow of induced currents in the conductive medium will be lower in the thicker medium.

Referring to FIG. 7, in one example, a controlled leakage inductance transformer 30, for use, for example, in a zero-current switching converter, includes a magnetic core structure having two identical core pieces 32, 34. Two plastic bobbins 36, 38 hold primary and secondary windings 40, 42. The ends of the windings are connected to terminals 44, 46, 48, 50. Two copper conductive cups 52 (formed by cutting, bending, and soldering high conductivity copper sheet) are slip fitted onto the cores to form the conductive medium. For the transformer shown, the distance between the ends of the mated core halves is 1.1 inches, the outside width of the core pieces is 0.88 inches, the height of the core pieces is 0.26 inches, and the core cross sectional area is an essentially uniform 0.078 $in^2$. The core is made of type R material, manufactured by Magnetics, Inc., Butler, Pa. The two copper cups are 0.005 inches thick and fit snugly over the ends of the core pieces. The length of each cup is 0.31 inches. The primary winding comprises 20 turns of 1×18×40 Litz wire, and the secondary comprises 6 turns of 3×18×40 Litz wire. Primary and secondary winding DC resistances are Rpri=0.17 ohms and Rsec=0.010 ohms, respectively. Without the cups in place, the measured total primary inductance of the transformer, with the secondary open-circuit (i.e. the sum of the primary leakage inductance and the magnetizing inductance), was essentially constant and equal to 450 microHenries between 1 KHz and 500 KHz, rising to 500 microHenries at 1 MHz, owing to peaking of the permeability value of the material near that frequency. With the cups, the total primary inductance of the transformer, with the secondary open-circuit, was again essentially constant and equal to 440 microHenries between 1 KHz and 500 KHz, rising to 490 microHenries at 1 MHz, again owing to peaking of the permeability value of the material near that frequency. Measurements of transformer primary inductance, with the secondary winding short circuited, Lps, were taken between 1 KHz and 1 MHz, both with and without the cups in place, the results being shown in FIG. 8. In the Figure, Lps1 is the inductance for the transformer without the cups; Lps2 is the inductance for the transformer with the cups. At frequencies above a few kilohertz, inductive effects predominate (e.g. the inductive impedances are relatively large in comparison to the winding resistances) and, owing to the relatively large value of magnetizing inductance, the measured values of Lps1 and Lps2 are, with reference to FIG. 2, essentially equal to the sum of the primary-referenced values of the two leakage inductances, $Lps=Ll1+a^2Ll2$. Lps can therefore be referred to as the primary-referenced leakage inductance. For the transformer without the cups, the primary-referenced leakage inductance is essentially constant over the frequency range, whereas for the transformer with the cups, the primary-referenced leakage inductance declines rapidly and is essentially constant above about 250 KHz (at which frequency the thickness of the cups corresponds to about one skin depth), converging on a value of about 14 microhenries (a 55% reduction compared to the transformer without the cups). The interwinding capacitance of the transformer (i.e. the capacitance measured between the primary and secondary windings) was measured and found to be 0.56 picoFarads.

Figure 9:
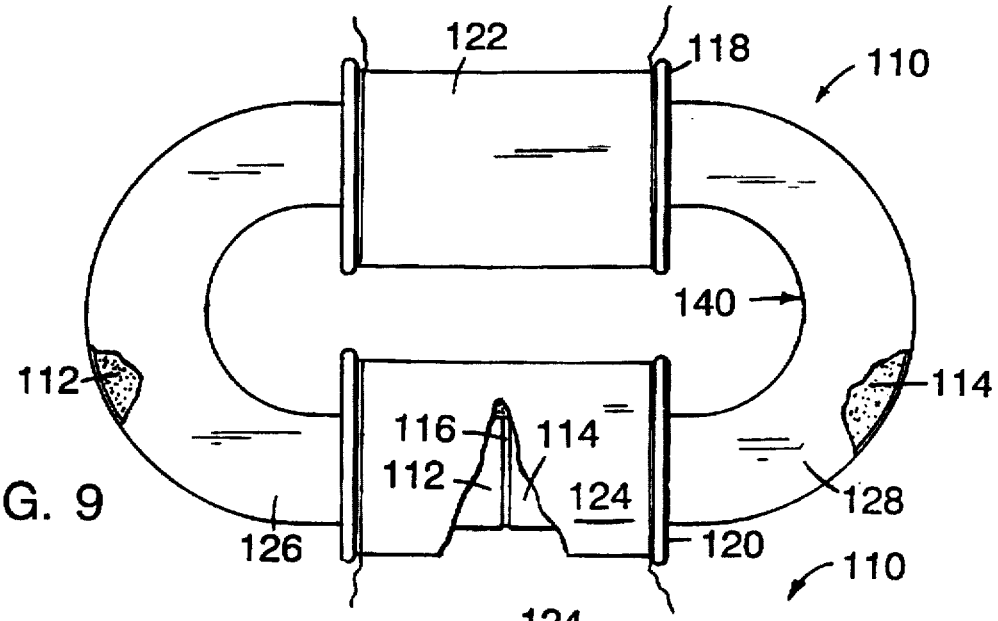
FIG. 9 is a top view, partly broken away, of a transformer.
Figure 10:
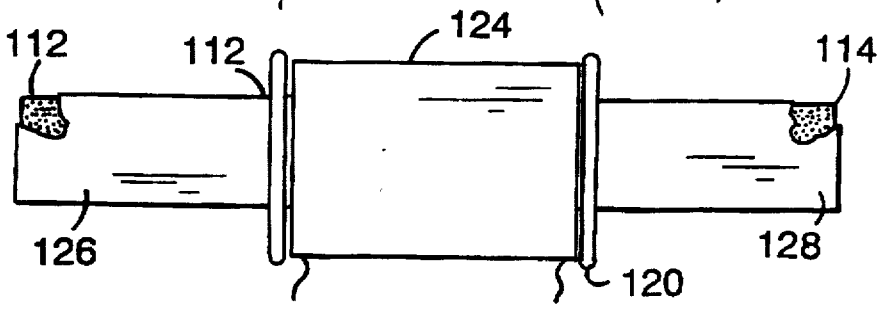
FIG. 10 is a side view, partly broken away, of the transformer of FIG. 9.

Referring to FIGS. 9 and 10, in another example a low-leakage inductance transformer 110, for use, for example, in a PWM power converter, includes a magnetic core structure having two U-shaped core pieces 112, 114 which meet at interfaces 116. Two copper housings 126, 128 are formed over the U-shaped cores and also meet at the interface 116. Each copper housing includes a narrow slit 140 (the location of which is indicated by the arrow but which is not visible in the Figures) which prevent the copper housings from appearing as shorted turns relative to the flux passing between the two windings. (In Soviet patent 620805, Perepechki & Fedorov, form an "open turn flush with a magnetic circuit" as a means of performing conductivity measurements based upon the magnetic shielding effect of a conductive material; in British Patent Specification 990,418, open turns are used to modify the distribution of the leakage field near the edges of tapewound windings, thereby reducing losses caused by interaction of the leakage field with the current in the windings.) Two hollow bobbins 118, 120 are wound with wire to form primary and secondary windings 122, 124. The two bobbins are arranged side-by-side and the ends of the two U-shaped cores, along with their respective conductive housings, lie within the hollows of the bobbins to form a closed magnetic circuit which couples the windings. In the transformer of FIGS. 9 and 10, the conductive medium covers essentially all of the surface of the magnetic core.

Figure 7A:
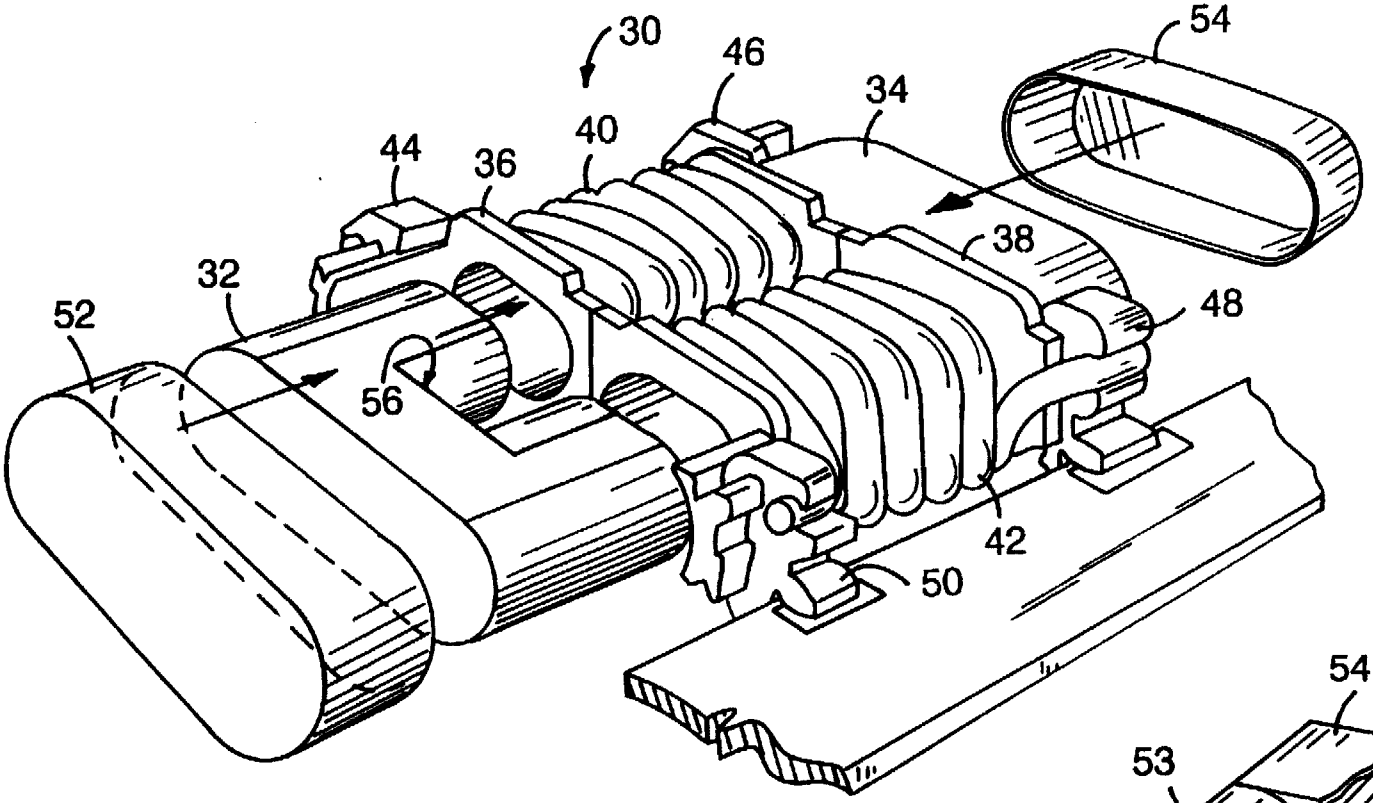
FIGS. 7A and 7B show, respectively, a partially exploded perspective view of a transformer and a perspective view, broken away, of an alternate embodiment of the transformer of FIG. 7A which includes a conductive band.
Figure 7B:
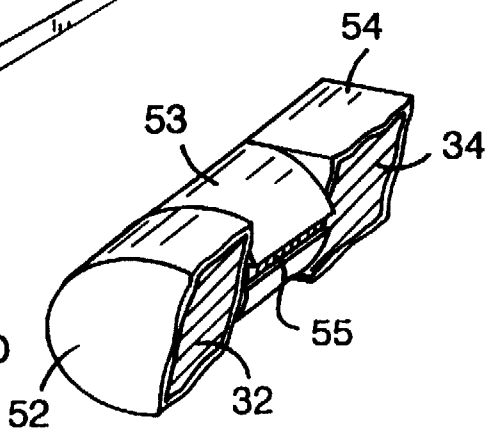

As an example of the effect of essentially completely enshrouding the magnetic core with a conductive metal housing, a transformer of the kind shown in FIG. 7, having the dimensions, core material and winding configuration previously cited, was modified by (a) replacing the copper cups with a 0.0075 inch thick coating of copper which was plated directly onto the core pieces using an electroless plating process, but which otherwise had the same shape and dimensions of the copper cups previously cited, and (b) adding 0.005 inch thick copper bands underneath the winding bobbins. As shown FIG. 7B, which shows a broken away view of the transformer with one band 53 visible, the bands, which extended under the windings (not shown in FIG. 7B) from the edge of one copper cup 52 to the edge of the other 54, were wrapped around the legs of each core piece 32, 34 leaving a narrow slit 55 (approximately 0.030 inches wide) along the inside surface of the core to prevent forming a shorted turn. Without the copper cups or bands, the values of the total primary inductance and the primary-referenced leakage inductance were as previously cited. However, with the cups and bands in place, the measured value of primary referenced leakage inductance was reduced to 5.6 microHenry at 1 MHz (an 82% reduction). The interwinding capacitance for this transformer was measured and found to be 0.64 picoFarads.

For comparative purposes, a prior art transformer was constructed to exhibit essentially the same value of primary-referenced leakage inductance as the transformer described in the previous paragraph. The prior art transformer was constructed using the same core pieces and the same primary winding used in the previously cited examples, but, instead of having separated windings, the secondary winding was overlaid on top of the primary winding and the radial spacing between windings was adjusted (to about 0.030 inch) to achieve the desired value of primary-referenced leakage inductance. The primary-referenced leakage inductance of the prior art transformer constructed with overlaid windings was 5.31 microHenry at 1 MHz, and the interwinding capacitance was 4.7 picoFarads. Thus, for a comparable value of leakage inductance, the transformer according to the present invention had a greater than sevenfold reduction in interwinding capacitance and a significantly greater interwinding breakdown voltage capability owing to its separated windings.

Figure 11:
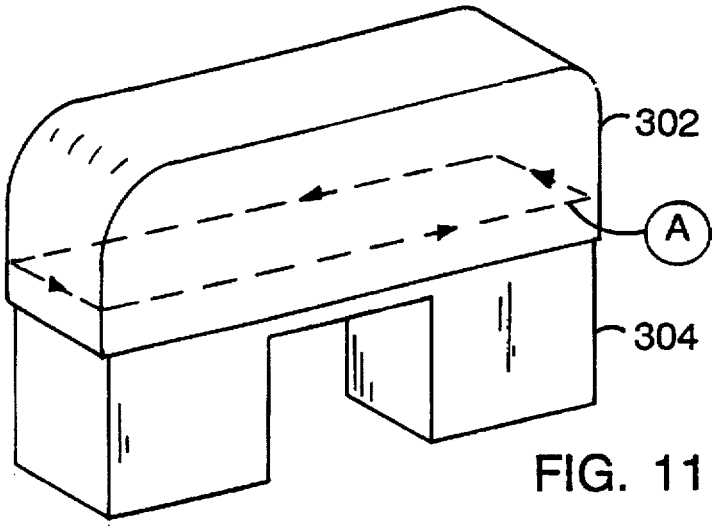
FIG. 11 shows a one-piece conductive medium mounted over a portion of a magnetic core and indicates one continuous path through which induced currents may flow within the conductive medium.
Figure 12:
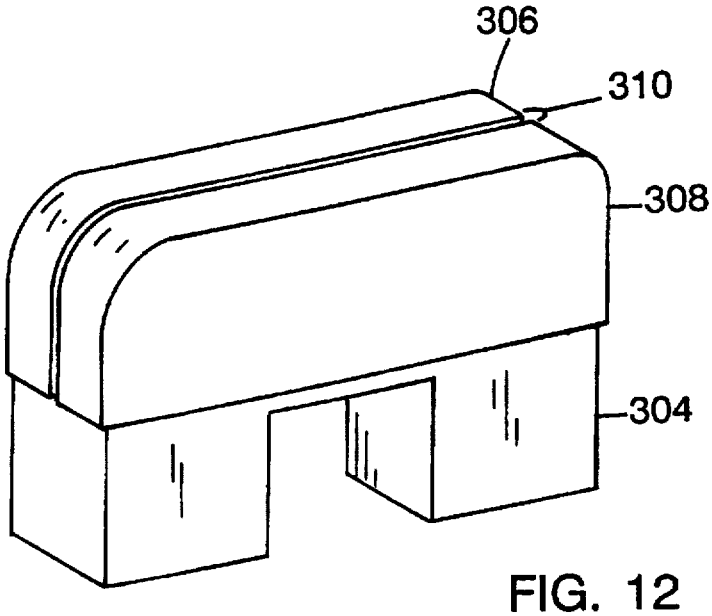
FIG. 12 shows a conductive medium, formed of two symmetrical conductive pieces separated by a slit, mounted over a portion of a magnetic core.
Figure 13:
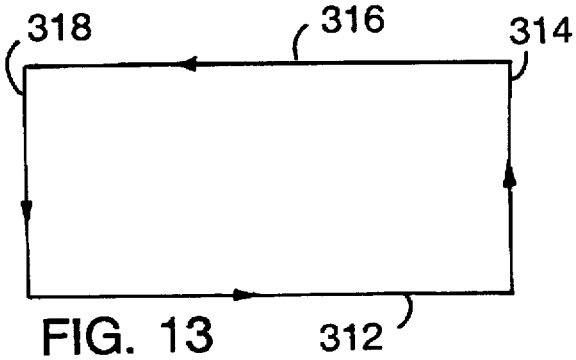
FIG. 13 shows an example of an induced current flowing along a path in the conductive medium of FIG. 11.
Figure 14:
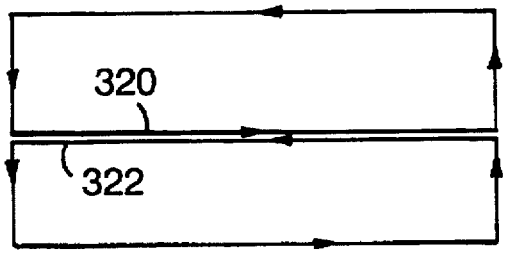
FIG. 14 shows two induced currents, flowing along paths in the two parts which form the conductive medium of FIG. 12, which will produce essentially the same flux confinement effect as that caused by the induced current illustrated in FIG. 13.

In transformer embodiments in which the conductive medium is overlaid on the surface of the magnetic medium, it is desirable to arrange the conductive medium so that (a) it enshrouds surfaces of the magnetic media from which the bulk of the leakage flux would otherwise emanate, (b) it does not form a shorted turn with respect to mutual flux, and (c) losses associated with the flow of induced currents in the conductive medium are minimized. Surfaces of the magnetic medium through which the majority of leakage flux can be expected to emanate will depend on the specific configuration of the transformer. For example, for the transformer of FIG. 7 without the conductive cups 52,54, the bulk of the leakage flux will emanate from the outward facing surfaces of the magnetic core and a much smaller fraction of flux will pass between the opposing inner faces 56 of the core pieces. Thus, for a transformer of the kind shown in FIG. 7, covering the outward facing surfaces with a conductive medium will result in containment of the majority of the leakage flux. However, the physical arrangement of the conductive medium cannot be arbitrarily chosen, since flow of induced currents in the conductive medium will result in power loss in the medium, and the relative amount of this loss will differ for different arrangements of the medium. For example, FIGS. 11 and 12 illustrate two possible ways of arranging a conductive medium to cover the outward facing surfaces of a core piece 304. In FIG. 11, the conductive medium 302 overlays the entire outer surface at the end of the core piece, similar to the cup used in the transformer of FIG. 7. In FIG. 12, the conductive medium also covers essentially the entire outer surface of the end of the core piece, but, instead of being formed as a single continuous piece it is formed out of two symmetrical parts 306, 308 which are separated by a very narrow slit 310. Neither the conductive medium in FIG. 11, nor the one in FIG. 12 form a shorted turn with respect to mutual flux. Since the conductive media in both Figures cover essentially all of the outward facing surfaces at the end of the core piece, each can be expected to have a similar effect in terms of containing leakage flux (i.e. each conductive medium would have an essentially similar effect in reducing leakage inductance). However, equal flux containment implies essentially equivalent distributions of induced current in each conductive medium, and in order for this to be so, currents will flow along paths in the conductive medium of FIG. 12 that do not flow in the conductive medium of FIG. 11. For example, consider an induced current flowing along path A in the conductive medium of FIG. 11. As shown in FIG. 13 (which shows current flowing in path A as viewed from above the conductive medium) this current can flow continuously along the front 312, sides 314, 318 and rear 316 of the medium. Because of the presence of the slit in the conductive medium of FIG. 12, however, an uninterrupted loop of current cannot flow along a similar path. Instead, a loop of current will flow in each part of the conductive medium, as shown in FIG. 14 (which shows currents flowing in the two parts of the conductive medium of FIG. 12 as viewed from above). Since the slit is narrow, the magnetic effects of the currents which flow in opposite directions along the edges of the slit 320, 322 will tend to cancel, and the net flux containment effect of the two current loops in FIG. 14 will be essentially the same as the effect of the single loop of FIG. 13. However, the currents flowing along the edge of the slit (320, 322 FIG. 14) will produce losses in the conductive medium of FIG. 12 that are not present in the conductive medium of FIG. 11. In general, then, the arrangement of the conductive medium of FIG. 11 will be more efficient (i.e. exhibit lower losses) than that of FIG. 12 because, for equivalent current distributions, the presence of the slit in the conductive medium of FIG. 12 will give rise to current flow, and losses, along the edges of the slit which do not exist in the conductive medium of FIG. 11.

To illustrate the effect of interrupting current paths in the conductive medium, a transformer of the kind shown in FIG. 7, having the dimensions, core material and winding configuration previously cited, was modified by replacing the copper cups with a 0.009 inch thick layer of copper tape, but which otherwise had the same shape and dimensions of the copper cups previously cited. The primary-referenced leakage impedance (i.e. the equivalent series inductance and series resistance measured at the primary winding with the secondary winding shorted) was measured at a frequency of 1 MHz under three different conditions (see FIG. 15): with no conductive medium in place; with a fully intact conductive medium in place; with a continuous narrow slit (approximately 0.010 inches wide) cut along the sides and top of the conductive media at both ends of the transformer (FIG. 15A); and with both the latter slit and with slits cut vertically in both conductive media along the center of each face of the core (FIG. 15B). The equivalent series resistance without the conductive media in place can be considered as a baseline indicative of losses in the windings (due to winding resistance, including skin effect in the windings themselves) and in the core. The increase in resistance for units with the conductive media in place is due to the presence of the media itself. As shown in FIG. 15C, an increase in the extent to which the slits disrupt conductive paths within the media has a relatively small effect on leakage inductance, but the effect on equivalent series resistance is very significant. In general, then, for a desired amount of flux confinement, the efficiency of the transformer can be optimized by arranging the conductive medium so that it: (a) covers those surfaces of the magnetic medium from which the majority of leakage flux would otherwise emanate (without forming a shorted turn with respect to mutual flux), and (b) forms an uninterrupted conductive sheet across those surfaces.

Figure 16:
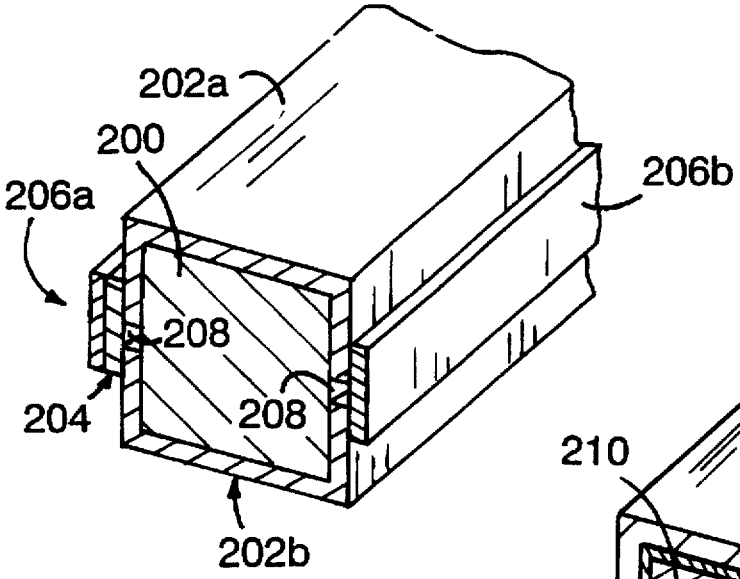
FIGS. 16 through 18 show techniques for enshrouding a portion of a magnetic core.
Figure 17:
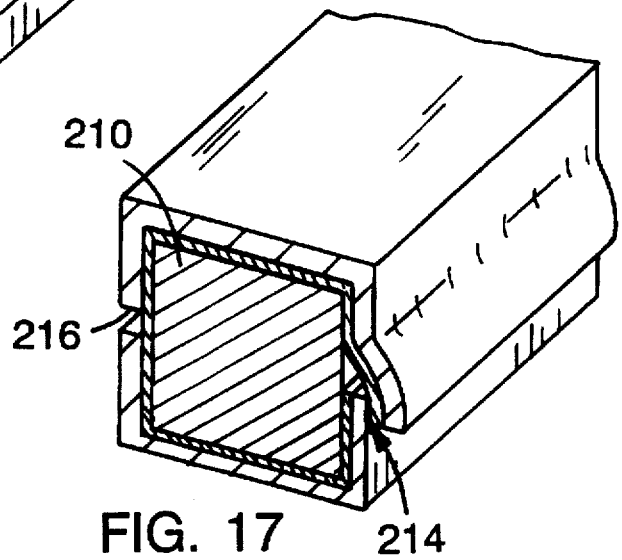
Figure 18:
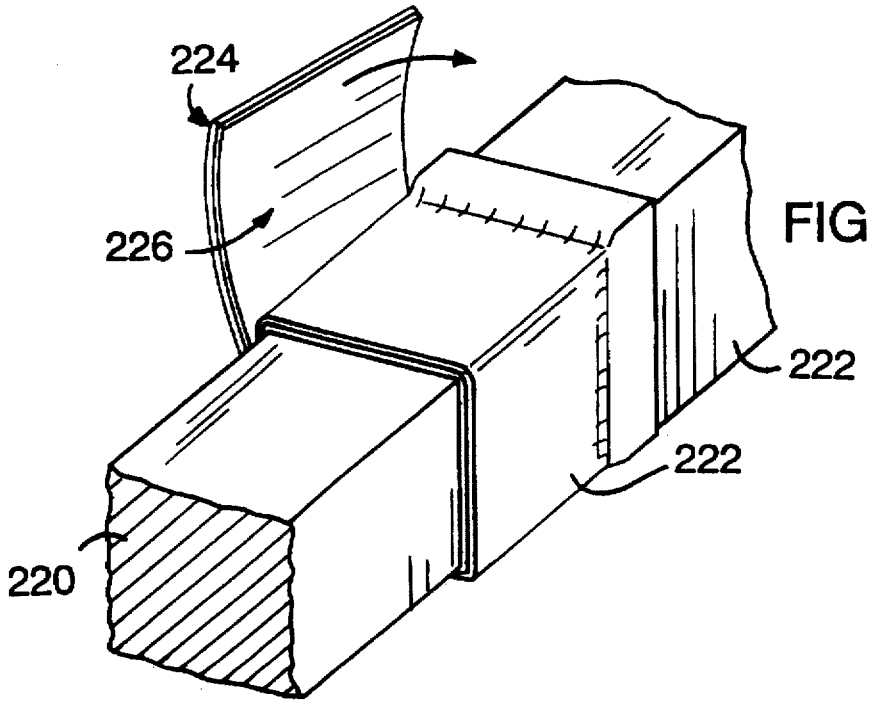

In cases where minimum leakage inductances are sought (e.g. in a low-leakage inductance transformer for use in a PWM converter), it is desirable to completely enshroud the magnetic medium with conductive material while avoiding forming a shorted turn with respect to the flux which couples the windings. For example, in FIG. 16, which shows a sectioned view of a conductively coated core piece, two copper housings 202*a*, 202*b*, are overlaid (or plated) over the magnetic core medium 200. Slits 208 separate the two copper housings. Two copper strips 206*a*, 206*b*overlay the slits, one of the strips 206*b* being electrically connected to the copper housings, and one of the strips 206*a* being electrically insulated from the housings by an interposed strip of insulating material 204. A copper tape, having an insulating, self-adhesive, backing could be used instead of separate copper and insulating strips. Another technique, shown in FIG. 17, uses a layer of copper 214 and a layer of insulating material 216 to completely enshroud the magnetic core 216. The insulating material prevents the copper from forming a shorted turn at the region in which the layers overlap. In FIG. 18, a tape 222 composed of a layer of adhesive coated copper 226 and a layer of insulating material 224 is shown being wound around a magnetic core 220. With reference to the discussion in the preceding paragraph, use of a relatively wide tape will minimize losses associated with disruption of optimal current distribution in a conductive medium formed in this way. These, and other techniques using one or more patterns of conductive material, can be used to form conductive coatings which maximize flux confinement within the magnetic core (or a portion thereof) without creating shorted turns.

Figure 8:
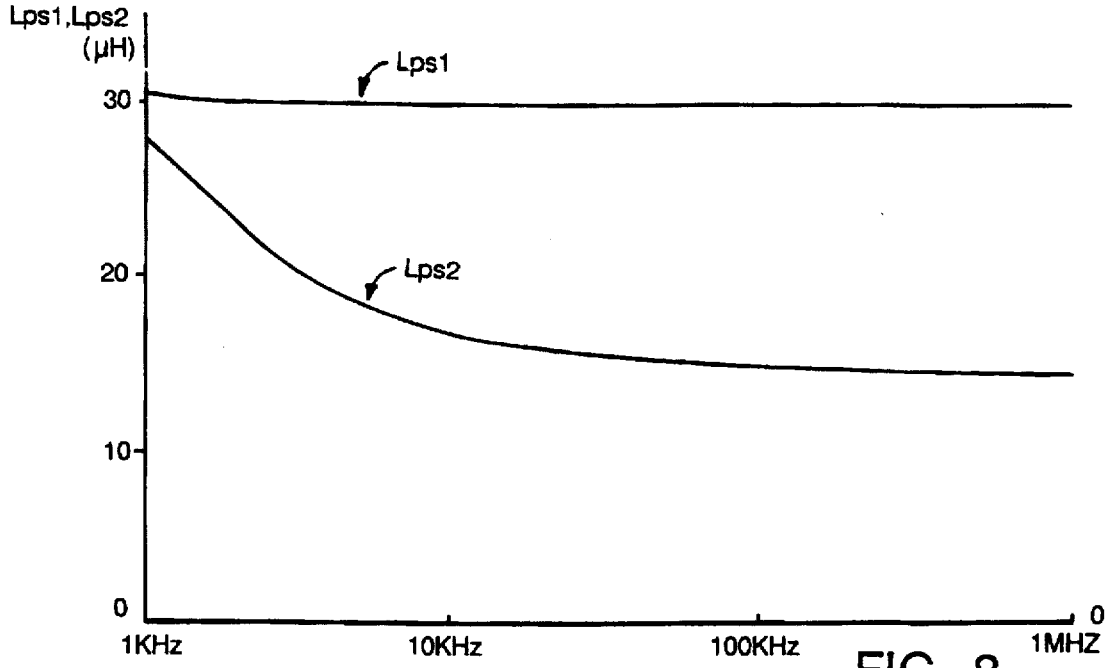
FIG. 8 illustrates the measured variation of the primary-referenced leakage inductance, with the secondary winding shorted, as a function of frequency, for the transformer of FIG. 7 both with and without the conductive cups.

The transformer embodiments described above have been of the kind where a conductive medium is overlaid directly upon the surface of the magnetic medium. In other embodiments, the conductive medium may be formed of conductive sheets which are arranged in the environment surrounding the magnetic medium and the windings (e.g. as shown schematically in FIG. 5). In an important class of applications—modular DC-DC switching converters—the transformer may already be located in close proximity to a relatively thick conductive baseplate which forms one of the surfaces of the packaged converter. For example, FIG. 19 shows a sectioned side view of one such converter module wherein the core 902 and the windings 904, 906 of a transformer lie in a plane which is parallel to a metal baseplate 908 which forms the top of the unit. The transformer is mounted to a printed circuit board 910 which contains other electronic components, and a nonconductive enclosure 912 surrounds the remainder of the unit. The effects on primary-referenced leakage impedance of parallel conductive sheets in the vicinity of a transformer of the kind shown in FIG. 7A (having the same dimensions, materials, and windings), and the effects of parallel sheets in combination with conductive media overlaid on the magnetic media, are illustrated in FIG. 20. As shown in the Figure, measurements of primary-referenced leakage impedance, at a frequency of 1 Mhz, were taken under four different conditions: with no conductive medium in the vicinity of the transformer (which, in FIG. 20 appears as an end view of the windings 904, 906 and magnetic core 902) and without any copper cups (i.e. 52, 54 FIG. 7A) over the ends of the magnetic core; with the transformer centered on the surface of a flat plate 914 made of 6063 aluminum alloy ($r=3.8\times10^{-8}$ ohm-meters), measuring 2.4"×4.6"×0.125", and without the copper cups over the ends of the magnetic core; with the transformer, without the copper cups over the ends of the magnetic core, centered on the cited aluminum plate and with a piece of 0.005" thick soft copper sheet 916, sized to overhang the periphery of the transformer by approximately 0.25" along each side, placed over the opposite side of the transformer, essentially in parallel with the aluminum plate; and in the latter configuration, but with the copper cups (not shown in the Figure), of the kind previously described, added to both ends of the transformer's magnetic core (i.e. as shown in FIG. 7A). As shown in the Table in FIG. 20, the aluminum plate reduces the primary-referenced leakage inductance by about 30%, with little effect on equivalent series resistance; the combination of the two parallel sheets of aluminum and copper produces a greater than 50% reduction in primary-referenced leakage inductance (comparable to the effects of the copper cups alone, as shown in FIG. 8) with a relatively smaller increase in equivalent series resistance; and the combination of the parallel sheets and copper cups reduces the primary-referenced leakage inductance by more than 72%, again with a relatively smaller increase in equivalent series resistance.

Comparison of the equivalent series impedance of three cases—the transformer of FIG. 7A with only the copper cups over the ends of the core; the transformer described in FIG. 15C with the unslit conductive tape over the ends of the core; and the transformer of FIG. 20 with the two parallel sheets—shows that all three configurations exhibit similar values of leakage inductance at 1 MHz: 14.0 microHenry, 15.3 microHenry, and 14.5 microHenry, respectively. However, the measured values of equivalent series resistance for the three transformers are, at 1 MHz, respectively, 2.38 ohms, 2.98 ohms, and 1.44 ohms. For further comparison, the primary-referenced leakage impedance of a controlled leakage inductance transformer used in a production version of a converter module of the kind shown in FIG. 19, constructed using overlaid windings inside of a pair of mating pot cores and occupying essentially the same volume of the transformer shown in FIG. 7A, was also measured at 1 Mhz. The primary-referenced leakage inductance was 10 microHenry, and the equivalent series resistance was 2.2 ohms. Comparison of the relative values of equivalent series resistances that: (a) a transformer according to the present invention, comprising a magnetic medium coupling separated windings and a conductive medium arranged in the environment outside of the windings and magnetic medium, can produce a significant reduction in primary-referenced leakage inductance with relatively little degradation in transformer efficiency (i.e. the percentage of power transferred from a source to a load, via the transformer, the difference being dissipated as heat in the transformer), and (b) such a transformer can exhibit better efficiency, and hence lower losses, than either a comparable prior art transformer having overlaid windings or a transformer according to the present invention using only conductive media formed over the surface of the magnetic media.

Another example of a conductive medium arranged in the environment outside of the magnetic medium and windings is shown in FIG. 21. In the Figure a transformer of the kind shown in FIG. 7A (i.e. having the same dimensions, materials and windings, and which, in FIG. 21, appears as an end view of the windings 904,906 and magnetic core 902) is surrounded by an oval tube 920 made of 0.010" thick copper. The inside dimensions of the oval copper tube 1.25"×0.5", and the length of the tube is 1.25". The ends of the tube are open. In the Figure, the values of primary-referenced leakage inductance and equivalent series resistance are shown for three different conditions: with no conductive medium in the vicinity of the transformer and with no copper cups over the ends of the magnetic core; with the copper tube surrounding the transformer, but without the copper cups; and with the copper tube surrounding the transformer and with the copper cups over both ends of the magnetic core. As can be seen in the Figure, (a) the primary-referenced leakage inductance is reduced by as much as 78%, (b) in no case is there a significant increase in equivalent series resistance and (c) the equivalent series resistance is relatively low.

Figure 22:
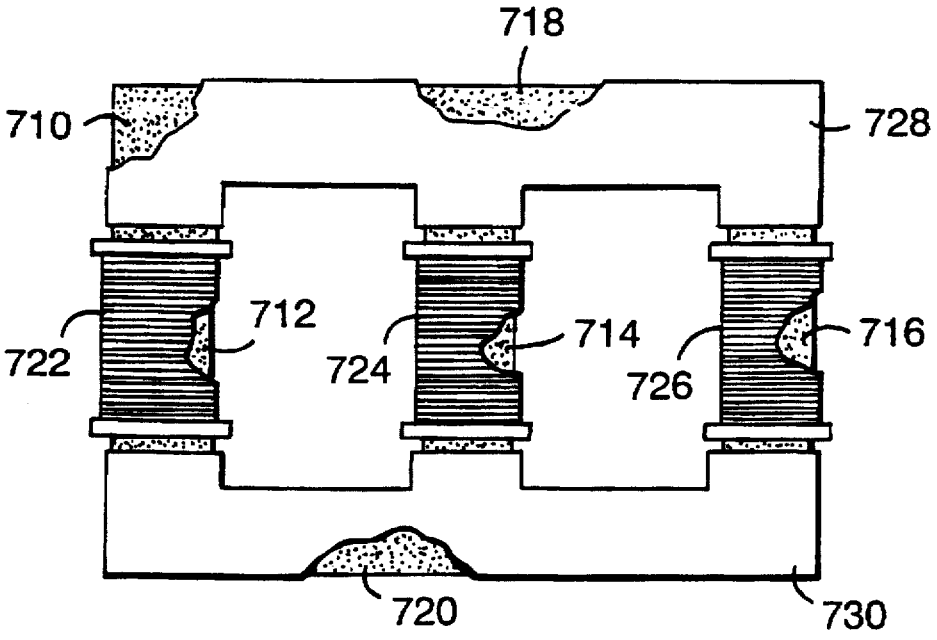
FIG. 22 shows a transformer having a multiply connected core which forms two looped flux paths.

The actual magnetic medium and conductive medium may have any of a wide range of configurations to achieve useful operating parameters. The magnetic medium may be formed in a variety of configurations (i.e. in the mathematical sense, the domain of the magnetic medium could be either singly, doubly or multiply connected) with the two windings being separated by a selected distance in order to achieve desired levels of interwinding capacitance and isolation. For example, the magnetic cores used in the transformers of FIGS. 7 and 9 form a single loop (i.e. the domain of the magnetic medium is doubly connected in these transformers). An example of a transformer having a magnetic medium which forms two loops (i.e. in which the domain of the magnetic medium is multiply connected) is shown in FIG. 22. In the Figure, the magnetic core 710 comprises a top member 718 and a bottom member 720 which are connected by three legs 712, 714, 716. The three legs are enclosed by windings 722, 724, 726. Conductive media 728, 730 are formed over the top and bottom members of the core, respectively, and a portion of each of the legs. Slits in the conductive media (not shown in the Figure) preclude formation of shorted turns with respect to mutual flux which couples the windings. One loop in the magnetic medium 710 is formed by the left leg 712, the center leg 714 and the leftmost portions of the top and bottom members 718, 720. A second loop in the magnetic medium 710 is formed by the center leg 714, the right leg 716 and the rightmost portions of the top and bottom members 718, 720.

The conductive medium can be arranged in any of a wide variety of patterns to control the location, spatial configuration and amount of transformer leakage flux. At one extreme the entire magnetic medium can be enshrouded with a relatively thick (e.g. three or more skin depths at the transformer operating frequency) conductive medium formed over the surface of the magnetic medium and the leakage inductance can be reduced by 75% or more. Since an appropriately thick conductive shroud formed over a relatively high permeability magnetic core will, to first order, essentially eliminate emanation of time-varying flux from the surface of the magnetic core, the reduction in leakage inductance will, to first order, be essentially independent of the length of the mutual flux path (i.e. the length of the core) which links the windings. By acting as a "flux conduit" over the magnetic path which links the windings, an essentially complete overcoating of conductive material will allow very widely spaced windings to be used consistent with maintaining low values of leakage inductance. Very low values of leakage inductance may also be achieved by appropriate arrangement of conductive media in the environment outside of the magnetic medium and windings, or by combining conductive media in the environment outside of the magnetic medium and windings with conductive media formed over the surface of the magnetic medium. In other configurations, selective application of patterns of conductive material, either formed over the surface of the magnetic medium, or arranged in the environment outside of the magnetic medium and windings, or both, can be used to realize preferred spatial distributions of leakage flux and controlled amounts of leakage inductance. By this means reductions in leakage inductance of 25% or more can be achieved. Thus, the present invention allows construction of both low-leakage-inductance and controlled-leakage-inductance transformers.

Figure 23:
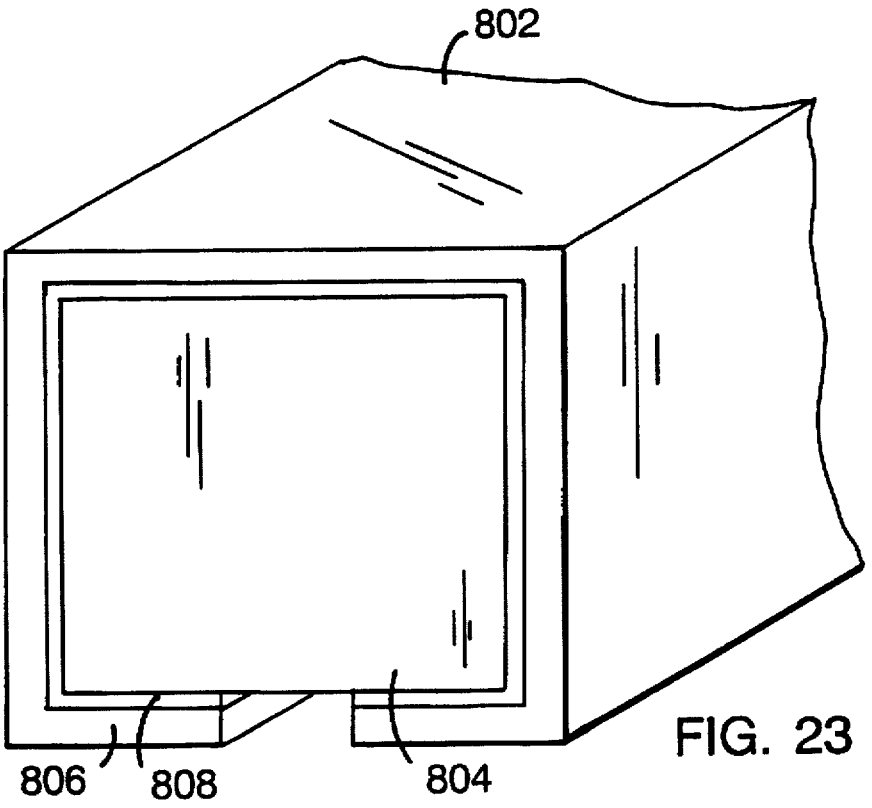
FIG. 23 shows a conductive medium comprising two layers of different conductive materials.

The conductive medium may be any of a variety of materials, such as copper or silver. Use of "superconductors" (i.e. materials which exhibit zero resistivity) for the conductive medium could provide significant reduction in leakage inductances with no increase in losses due to flow of induced currents. The conductive medium can also be formed of layers of materials having different conductivities. For example, with reference to FIG. 23, which shows a cross section of a portion of a conductive medium 802 overlaying a magnetic medium 804, the conductive medium comprises two layers of material 806, 808. For example, the material 808 closest to the core might be a layer of silver, and the other layer 806 might be copper. Since the conductivity of silver is higher than that of copper, a conductive medium formed in this way will have reduced losses at higher frequencies (where skin depths are shallower) than a conductive medium formed entirely of copper.

Since a transformer having separated windings (e.g. wound on separate bobbins) can usually be constructed using larger wire sizes than an equivalent transformer of the same size using interleaved or coaxial windings, and since appropriate arrangements of conductive media can reduce leakage inductance while maintaining low values of equivalent series resistance, transformers according to the present invention can be constructed to exhibit higher efficiency (i.e. have lower losses at a given operating power level) than equivalent prior art transformers. Since improved efficiency translates into lower operating temperatures at a given operating power level, and since separated windings will exhibit better thermal coupling to the environment, a transformer constructed in accordance with the present invention can, for a given maximum operating temperature, be used to process more power than a similar prior art transformer.

Figure 24:
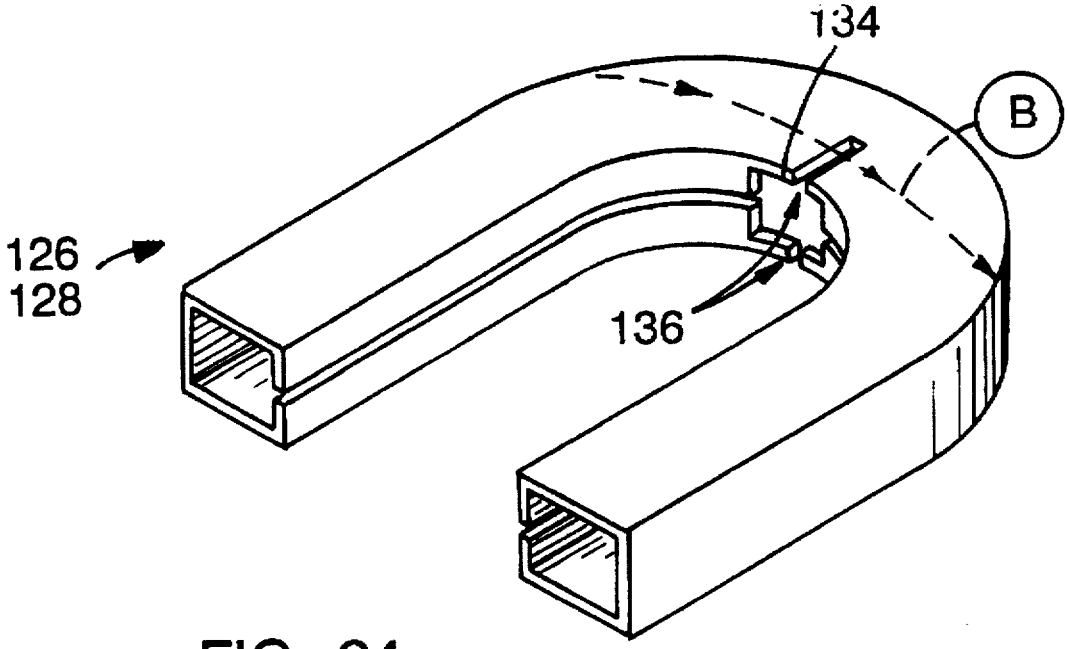
FIG. 24 is a perspective view of a metal piece.

Referring to FIG. 24, each of the metal pieces 126, 128 used in the transformer of FIGS. 9 and 10, might also include an aperture 134. The placement of the apertures is chosen to allow leakage flux to pass from the inside surface of the core on one side of the transformer to the inside surface of the core on the other side of the transformer in a direction parallel to the winding bobbins. To prevent closed conductive paths in the metal pieces (e.g. path B in the Figure which extends around the entire periphery of the piece) from appearing as a shorted turn to leakage flux which emanates through the aperture 134, slits (e.g. slits 136) might be needed in regions of the conductive medium in the vicinity of the aperture. The aperture sizes and the location of the slits are chosen to control the relative amount of leakage flux that may traverse the apertures, and therefore both the leakage inductances and the coupling coefficient of the transformer. Both the shape and dimensions of the metal pieces and the size and shape of the aperture and the slits may be varied to cover more or less of the core.

Figure 25:
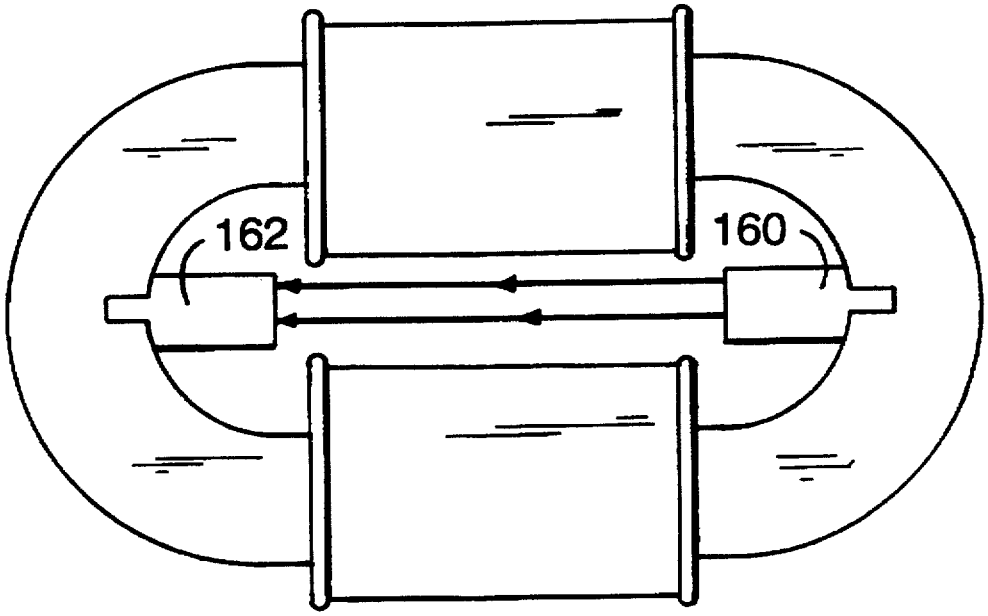
FIG. 25 is a top view of another transformer.
Figure 26:
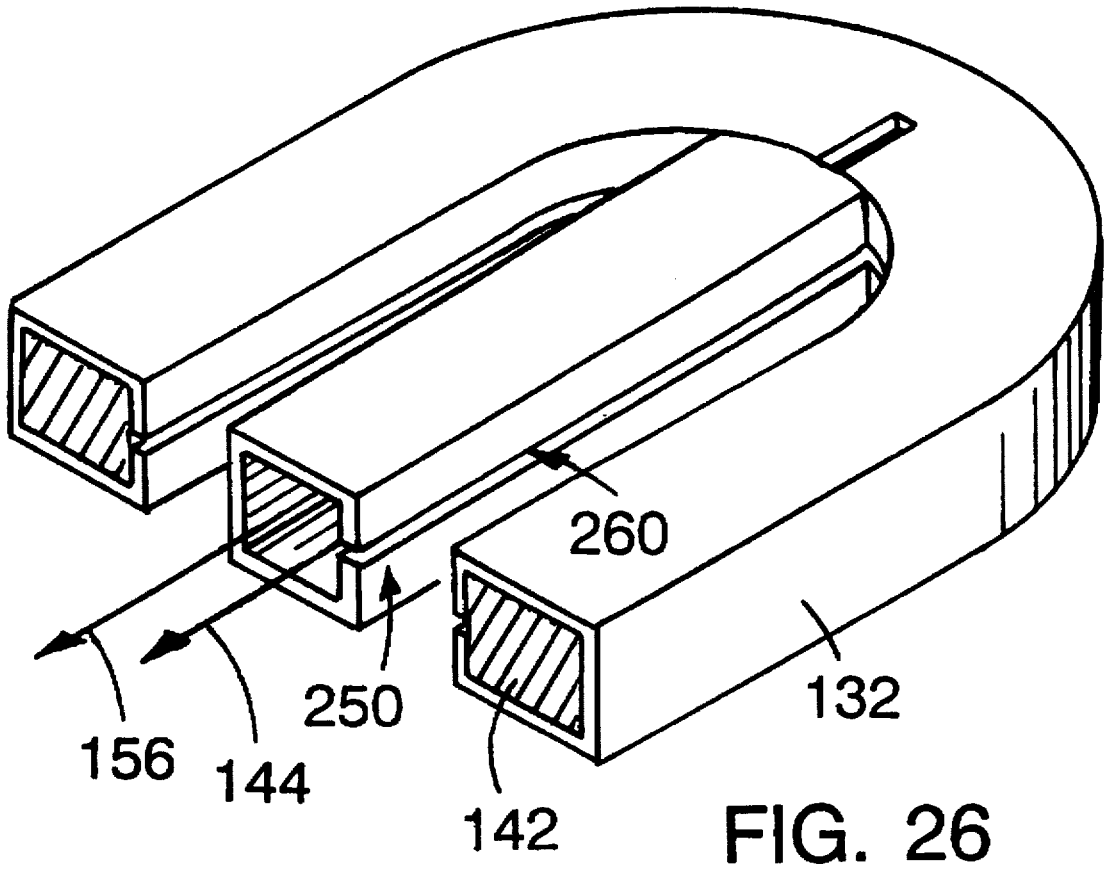
FIG. 26 shows one way of using a hollow tube, connected between a pair of apertures at either end of the conductive medium which covers a looped core, as a means of confining leakage flux to the interior of the tube.

Referring to FIG. 25, the magnetic core material in the region of the apertures could also be extended out toward each other, and each core half would appear more like an "E" shape. As the length of the core extensions 160, 162 is increased, and the gap between the ends of the extensions is decreased, the leakage inductance will increase. In effect, the reluctance of the path between the apertures is reduced by increasing the permeability of the path through which the leakage flux passes, thereby increasing the equivalent series inductance represented by the path. The conductive medium essentially constrains the leakage flux to the path between the core extensions; the leakage inductance is essentially determined by the geometry of the leakage path. To constrain the flux which passes between the apertures to a fixed domain, and essentially eliminate "fringing" of flux between the apertures, pairs of apertures may be joined by a hollow conductive tube, as shown in FIG. 26. In the Figure, the magnetic core 142 is covered with a conductive housing 132. However, instead of simply providing apertures for allowing lines of leakage flux 144, 156 to pass between the windings (not shown in the Figure), a hollow conductive tube 250 is used to connect the apertures at either end of the looped core. A slit 260 in the tube prevents the tube from appearing as a shorted turn to the leakage flux. The tube may also be constructed to completely enshroud its interior domain, without appearing as a shorted turn with respect to the leakage flux within the tube, by using a wide variety of techniques, some of which were previously described. Also, the reluctance of the path followed by the flux in the interior of the tube may be decreased by extending a portion of the magnetic core material into the region where the tube joins the housings (i.e. through use of core extensions 160, 162 of the kind shown in FIG. 25). In general, there are a wide variety of arrangements of magnetic media and conductive tubes that can be used between pairs of apertures to alter both the reluctance of the leakage flux path and the distribution of the flux. For example, instead of extending the magnetic medium through the apertures (i.e. as in FIG. 25), another way to reduce the reluctance of the leakage flux path is to suspend a separate piece of magnetic core material between a pair, or pairs, of apertures. Where a conductive tube is used, a section of magnetic material could be placed within a portion of the tube between the apertures.

Figure 27:
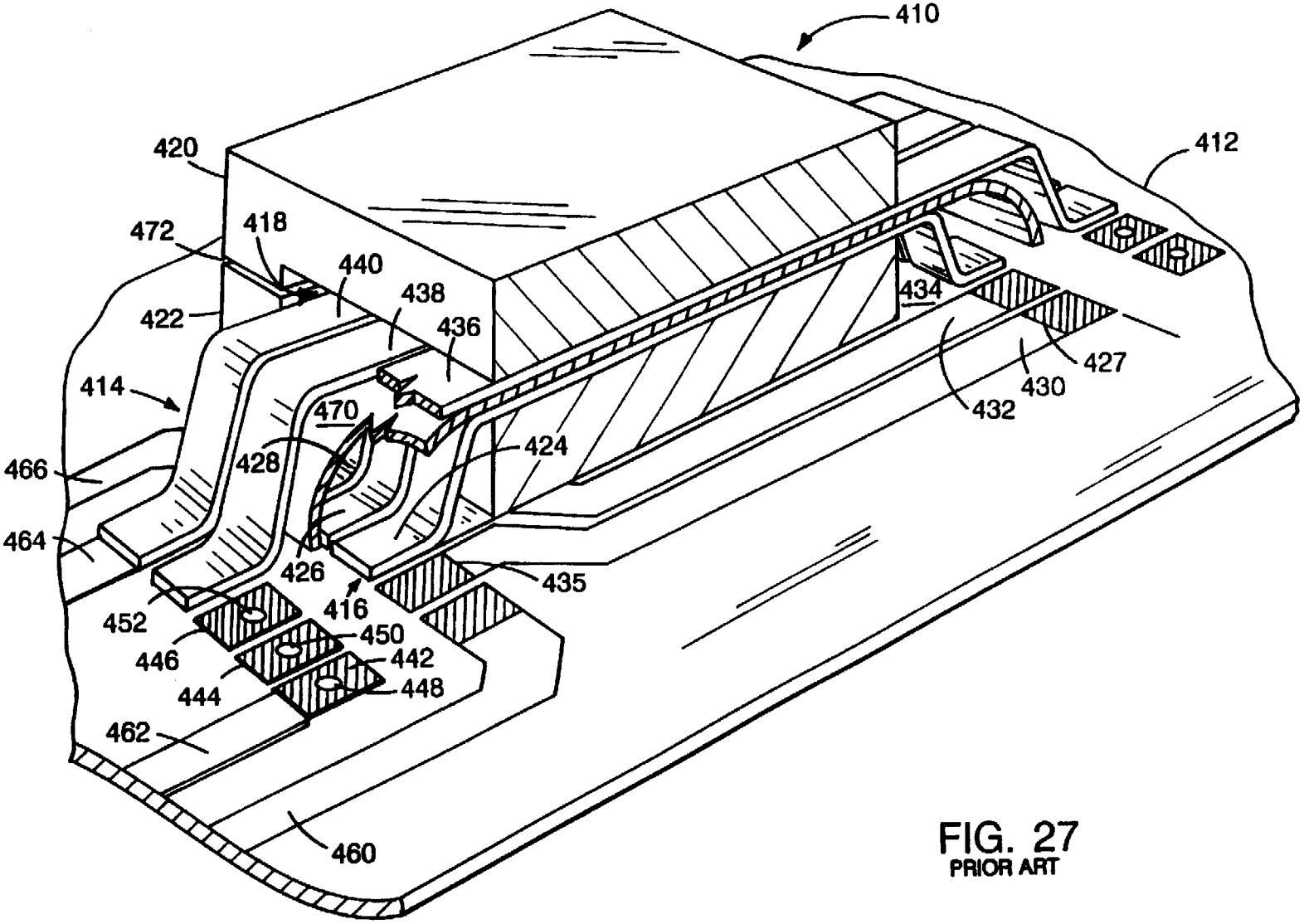
FIG. 27 PRIOR ART
FIG. 27 is a perspective view of a prior art transformer built with windings formed of conductors and conductive runs.

In the previous examples, the transformer windings were formed of wire wound over bobbins. The benefits of the present invention may, however, be realized in transformers having other kinds of winding structures. For example, the windings could be tape wound, or the windings could be formed from conductors and conductive runs, as described in Vinciarelli, "Electromagnetic Windings Formed of Conductors and Conductive Runs", U.S. patent application Ser. No. 07/598,896, filed Oct. 16, 1990 (incorporated herein by reference). FIG. 27 shows one example of a transformer 410 having windings of the latter kind. In the Figure the secondary winding 416 of the transformer is comprised of printed wiring runs 430,432,434 . . . , deposited on the top of a substrate 412 (e.g. a printed circuit board), and conductors 424, 426, 428 which are electrically connected to the printed wiring runs at pads (e.g. pads 435, 437) at the ends of the runs. The primary winding 414 is similarly formed of conductors 436, 438, 440, . . . and printed wiring runs, the runs being deposited on the other side of the substrate and connecting to pads on top of the substrate (e.g. pads 442, 444, 446, . . . ) via conductive through holes (e.g. holes 448, 450, 452). The primary and secondary conductors are overlaid and separated by an insulating sheet 470, and are surrounded by a magnetic core, the core being formed of two core pieces 420, 422.

Figure 28B:
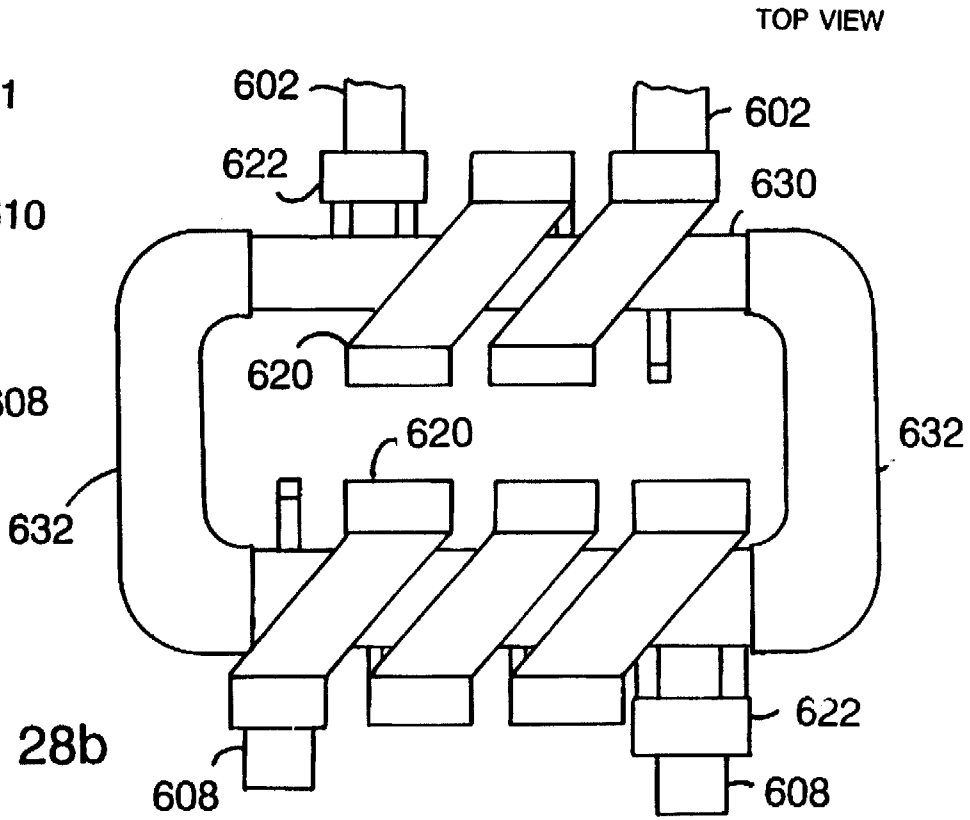
FIGS. 28A and 28B show an example of a transformer according to the present invention which uses the winding structure of FIG. 27.
Figure 28A:
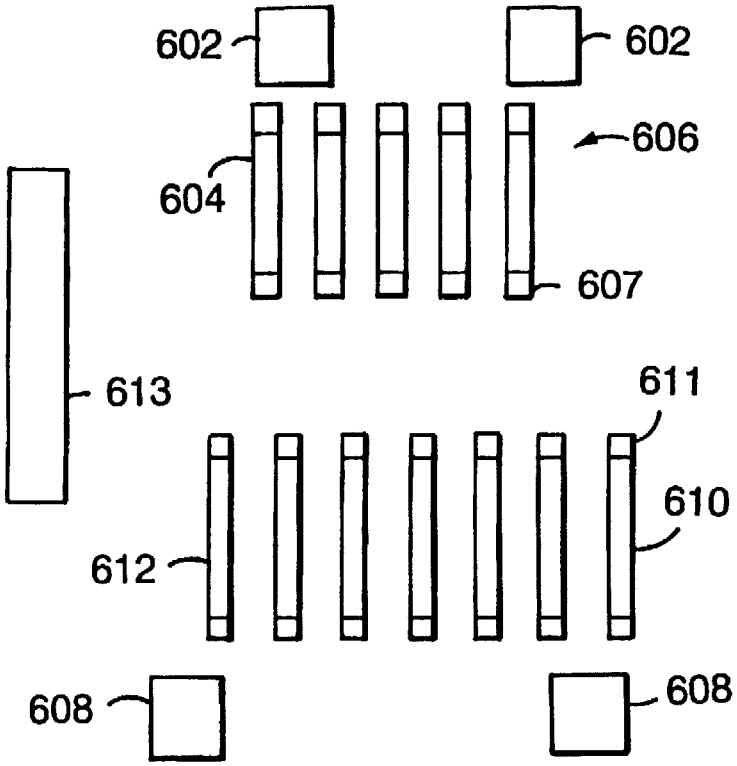

One reason for overlaying the windings in the transformer of FIG. 27 is to minimize leakage inductance. By use of the present invention, however, transformers may be constructed which (a) embody the benefits of the winding structure shown in FIG. 27, and (b) which also provide the benefits of separated windings and which exhibit low leakage inductance. One such transformer is illustrated in FIGS. 28A and 28B. In FIG. 28A a printed wiring pattern is shown which comprises a set of five primary printed runs 604 which end in pads 607; a set of seven secondary printed runs 610 which end in pads 611; and primary and secondary input termination pads 602, 608. In FIG. 28B, a transformer is constructed by overlaying the printed wiring pattern with a magnetic core 630, and then overlaying the magnetic core with electrically conductive members 620 which are electrically connected to sets of pads 607, 611 on either side of the core. The primary is shown to comprise two such members, which in combination with the printed runs form a two turn primary; the secondary uses three conductive members to form a three turn secondary. Conductive connectors 622 connect the ends of the windings to their respective input termination pads 602, 608. Some or all of the core 630 is covered with a conductive medium (for example, conductive coatings 632 on both ends of the core in FIG. 28B) using any of the methods previously described. The conductive medium allows separating the windings while maintaining low or controlled values of leakage inductance. Also, by providing for separated windings, all of the printed runs for the windings may be deposited on one side of the substrate (and, although the transformer of FIG. 28B has two windings, it should be apparent that this will apply to cases where more than two windings are required). Thus, the use of two-sided or multilayer substrates becomes unnecessary. Alternatively, the runs could be routed on both sides of the substrate as a means of improving current carrying capacity or reducing the resistance of the runs. It should also be apparent that additional patterns of conductive runs on the substrate can be used to form part of the conductive medium (for example, conductive run 613 in FIG. 28A).

Because the present invention provides for constructing high performance transformers having separated windings, and because such transformers may be designed to use simple parts and exhibit a high degree of symmetry (for example, as in FIG. 7), the manufacture of such transformers is relatively easy to automate. Furthermore, a wide variety of transformers, each differing in terms of turns ratio, can be constructed in real time, on a lot-of-one basis, using a relatively small number of standard parts. For example, families of DC-DC switching power converters usually differ from model to model in terms of rated input and output voltage, and the relative numbers of primary and secondary turns used in the transformers in each converter model is varied accordingly. In general, the number of primary turns used in any model would be fixed for a given input voltage rating (e.g. a 300 volt input model might have a 20 turn primary), and the number of secondary turns would be fixed for a given output voltage rating (e.g. a 5 volt output model might have a single turn secondary). Thus, a family of converters having models with input voltage ratings of 12, 24, 28, 48 and 300 volts, and output voltages ratings of 5, 12, 15, 24 and 48 volts, would require 25 different transformer models. Different models of prior art transformers must generally be manufactured in batch quantities and individually inventoried, since overlaid or interleaved windings must generally be constructed on a model by model basis. Each one of a succession of different transformers of the kind shown in FIG. 7, however, can be built in real time by simply automechanically selecting one bobbin 40 which is prewound (or wound in real time) with the appropriate number of primary turns, and another bobbin 42 having an appropriate number of secondary turns, and assembling these bobbins over the conductively coated core pieces 32, 34. Thus, while use of prior art transformers would require stocking and handling 25 different transformer models to manufacture the cited family of converters, use of the present invention allows building the 25 different models out of an on-line inventory of 10 predefined windings and a single set of core pieces.

Other embodiments are within the scope of the following claims. For example, the conductive medium may be applied in a wide variety of ways. The conductive medium may also be connected to the primary or secondary windings to provide Faraday shielding. The magnetic medium may be of nonuniform permeability, or may comprise a stack of materials of different permeabilities. The magnetic medium may form multiple loops which couple various windings in various ways. The magnetic core medium may include one or more gaps to increase the energy storage capability of the core.

We claim:

1. A transformer having a controlled value of leakage inductance comprising a magnetic core comprising a magnetic material arranged to form at least one loop and to carry magnetic flux longitudinally in the loop, the magnetic core having a surface through which a portion of the magnetic flux leaks as leakage flux, at least two windings that surround sections of the magnetic core to carry currents associated with the magnetic flux, and a conductive medium that surrounds, at substantially all locations along the loop except at sections surrounded by the windings, at least a portion of the surface of the magnetic core.

2. The transformer of claim 1 wherein the conductive medium also surrounds at least a portion of the surface of the magnetic core at locations within the sections surrounded by the windings.

3. The transformer of claim 1 or 2 wherein the conductive medium surrounds substantially all of the surface of the magnetic core at each location along the loop.

4. The transformer of claim 3 wherein the conductive medium includes a gap that runs longitudinally along the loop to prevent the conductive medium from forming a shorted turn around the magnetic core.

5. The transformer of claim 4 wherein the gap runs along an inner circumference of the loop.

6. The transformer of claim 4 further comprising an insulating strip laid over at least a portion of the gap in the conductive medium, and a conductive strip laid over the insulating strip.

7. The transformer of claim 1 or 2 wherein the conductive medium comprises at least one conductive cup fitted over a portion of the loop.

8. The transformer of claim 7 wherein the loop comprises at least two substantially parallel leg sections connected at each end by one of at least two base sections, and wherein the conductive cup is shaped to fit snugly over one the base sections.

9. The transformer of claim 7 wherein the conductive medium further comprises a conductive material surrounding at least a portion of the magnetic core at locations within the sections surrounded by the windings.

10. The transformer of claim 1 or 2 wherein the conductive medium comprises a conductive tape.

11. The transformer of claim 10 wherein the conductive tape further comprising a layer insulating material.

12. The transformer of claim 10 wherein the conductive tape surrounds all of the surface of the magnetic core without forming a shorted turn.

13. The transformer of claim 1 or wherein the conductive medium comprises a metal plated onto the magnetic core.

14. The transformer of claim 1 or 2 wherein the magnetic core comprises two substantially U-shaped segments connected end-to-end to form the loop.

15. The transformer of claim 1 or 2 wherein the magnetic core comprises a single loop.

16. The transformer of claim 1 or 2 wherein the magnetic core comprises multiple loops.

17. The transformer of claim 1 or 2 wherein the conductive medium includes an aperture that allows flux to leak from the magnetic core.

18. The transformer of claim 17 wherein the magnetic core comprises a leg protruding through the aperture.

19. The transformer of claim 18 wherein at least a portion of the leg is covered by a conductive medium.

20. The transformer of claim 17 wherein the conductive medium also includes a second aperture that, in conjunction with the first aperture, creates a path for leakage flux outside the magnetic core.

21. The transformer of claim 20 wherein the magnetic core comprises a leg protruding through each aperture.

22. The transformer of claim 21 wherein at least a portion of each leg is covered by a conductive medium.

23. A transformer having controlled value of leakage inductance comprising a magnetic core comprising a magnetic material arranged to form at least one loop and to carry magnetic flux longitudinally in the loop, the magnetic core having a surface through which a portion of the magnetic flux leaks as a leakage flux at least two windings that surround sections of the magnetic core to carry currents associated with the magnetic flux, and a conductive cup that covers at least a portion of the surface of the magnetic core at one end of the loop.

24. The transformer of claim 23 wherein the magnetic core comprises two substantially U-shaped segments connected end-to-end to form the loop.

25. The transformer of claim 24 wherein the conductive cup covers one of the U-shaped segments at an area opposite the end connected to the other U-shaped segment.

26. The transformer of claim 23 wherein the loop comprises at least two substantially parallel leg sections connected at each end by one of two base sections, and wherein the conductive cup is shaped to fit snugly over one of the base sections.

27. The transformer of claim 26 wherein the conductive cup covers at least a portion of at least one of the leg sections.

28. The transformer of claim 27 wherein the conductive cup covers at least a portion of both leg sections.

29. The transformer of claim 28 further comprising a second conductive cup shaped to fit snugly over the other base section.

30. The transformer of claim 29 wherein both conductive cups each cover at least a portion of at least one of the leg sections.

31. The transformer of claim 29 wherein both conductive cups each cover at least a portion of both of the leg sections.

32. The transformer of claim 29 wherein the conductive cups cover substantially all of the leg sections.

33. A transformer having a controlled value of leakage inductance comprising a magnetic core comprising a magnetic material arranged to form multiple loops and to carry magnetic flux longitudinally in each of the loops, the magnetic core having a surface through which a portion of the magnetic flux leaks as leakage flux, at least two windings that surround sections of the magnetic core to carry currents associated with the magnetic flux, and a conductive medium formed over at least a portion of the surface of the magnetic core forming the loops, the conductive medium being structured and arranged to preclude formation of shorted turns with respect to flux being carried longitudinally in said loops.

34. The transformer of claim 37, wherein the conductive medium is formed over portions of the core forming each of the loops.

35. The transformer of claim 33, wherein the conductive medium comprises a slit.

36. The transformer of claim 33, wherein the magnetic core comprises three coupled legs, each of the legs being surrounded by one of the at least two windings.

37. A method of controlling leakage inductance in a transformer having a magnetic core formed by a magnetic medium configured to form at least one loop, sections of which are surrounded by at least two windings, comprising the steps of inducing a magnetic flux to flow longitudinally in the loop, allowing a portion of the magnetic flux to leak from a surface of the magnetic core, providing a conductive medium surrounding, at substantially all locations along the loop except at sections surrounded by the windings, at least a portion of the surface of the magnetic core, and restricting the leakage of flux from the surface of the magnetic core with the conductive medium.

38. The method of claim 37 further comprising restricting the leakage of flux from at least a portion of the magnetic core at locations within the sections surrounded by the windings.

39. The method of claim 37 or 38 further comprising restricting the leakage of flux from substantially all of the surface of the magnetic core at each location along the loop.

* * * * *

UNITED STATES PATENT AND TRADEMARK OFFICE

CERTIFICATE OF CORRECTION

PATENT NO. : 5,719,544

DATED : February 17, 1998

INVENTOR(S) : Patrizio Vinciarelli; Jay M. Prager

It is certified that error appears in the above-identified patent and that said Letters Patent is hereby corrected as shown below:

On the title page, item [54] and col. 1, line 3, INDUCANCES" should be --INDUCTANCES--.

On the cover page, category "[56] References Cited" under "Foreign Patent Documents", change reference "9199305" to --9119305--.

Col. 11, line 32, "$\mu$" should be --$\rho$--.

Col. 11, line 40, "p$\rho$=0" should be --$\rho$=0--.

Signed and Sealed this

Third Day of November, 1998

Bruce Lehman

*Attest:*

BRUCE LEHMAN

*Attesting Officer*

*Commissioner of Patents and Trademarks*